US006234218B1

(12) United States Patent
Boers

(10) Patent No.: US 6,234,218 B1
(45) Date of Patent: May 22, 2001

(54) SEMI-AUTOMATED AUTOMOTIVE PAINT DISPENSING SYSTEM

(75) Inventor: Arie Boers, Plymouth, MN (US)

(73) Assignee: X-PERT Paint Mixing Systems, Inc., Roseville, MN (US)

( * ) Notice: Subject to any disclaimer, the term of this patent is extended or adjusted under 35 U.S.C. 154(b) by 0 days.

(21) Appl. No.: 09/417,933

(22) Filed: Oct. 13, 1999

(51) Int. Cl.[7] ..... B65B 1/04

(52) U.S. Cl. ..... 141/83; 141/104; 141/284; 222/166; 222/77

(58) Field of Search ..... 141/18, 83, 100, 141/104, 192, 196, 247, 284, 391; 222/77, 160, 164, 166, 504; 177/60, 61, 64; 251/62, 63.4

(56) References Cited

U.S. PATENT DOCUMENTS

| | | | |
|---|---|---|---|
| 2,027,297 | 1/1936 | Tramposch | 259/107 |
| 2,035,646 | 3/1936 | Farrington | 259/108 |
| 2,050,809 | 8/1936 | Ruetz | 221/60 |
| 2,068,646 | 1/1937 | Hexter | 226/100 |
| 2,111,482 | 3/1938 | Ruetz | 221/60 |
| 2,370,997 | 3/1945 | Rudolph | 222/559 |
| 2,423,969 | 7/1947 | Foltz | 259/58 |
| 2,428,492 | 10/1947 | Haller | 259/67 |
| 2,521,384 | 9/1950 | Marienthal | 259/66 |
| 2,585,334 | 2/1952 | McCauley | 220/55 |
| 2,603,461 | 7/1952 | Marienthal | 259/64 |
| 2,636,643 | 4/1953 | McCauley | 222/80 |
| 2,757,910 | 8/1956 | O'Neill | 259/108 |
| 2,802,649 | 8/1957 | Stockton | 259/67 |
| 2,898,094 | 8/1959 | O'Neill, Jr. | 259/116 |
| 2,965,363 | 12/1960 | Worden | 259/67 |
| 3,021,118 | 2/1962 | Dedoes | 259/43 |
| 3,041,052 | 6/1962 | Dedoes | 259/122 |
| 3,118,653 | 1/1964 | Dodes | 259/66 |
| 3,147,891 | 9/1964 | Fielitz | 222/166 |
| 3,162,338 | 12/1964 | Grubelic | 222/484 |
| 3,175,808 | 3/1965 | Dedoes | 259/107 |

(List continued on next page.)

FOREIGN PATENT DOCUMENTS

| | | | |
|---|---|---|---|
| 858607 | 12/1952 | (DE) . | |
| 29 51 731 | 7/1980 | (DE) . | |
| 0 035 422 A1 | 9/1981 | (EP) | B44D/3/00 |
| 0 127 589 A2 | 12/1984 | (EP) | B44D/3/00 |
| 0 298 806 A1 | 1/1989 | (EP) | B01F/15/00 |

(List continued on next page.)

*Primary Examiner*—Steven O. Douglas
(74) *Attorney, Agent, or Firm*—Dicke, Billig & Czaja, P.A.

(57) ABSTRACT

Disclosed is a system for dispensing liquid paint components from their original containers into a paint receptacle according to a paint formula to form a liquid paint mixture. The dispensing system comprises a dispensing apparatus for dispensing the liquid paint component from its original container, and an apparatus for controlling the dispensing apparatus. The dispensing apparatus includes a mechanism for releasably receiving the original container of the liquid paint component, and a mechanism for dispensing the liquid paint component from its original container into the paint receptacle. The dispensing apparatus further includes a force applying mechanism for preventing leakage of the liquid paint component. The control apparatus includes a weigh cell and a control module coupled to the weigh cell and the dispensing mechanism. The weigh cell supports the paint receptacle to determine the weight of the liquid paint component dispensed into the paint receptacle. The control module controls the amount of the liquid paint component dispensed from its original container into the receptacle based upon information obtained from the weigh cell. The dispensing system virtually eliminates liquid paint component dispensing errors, thereby enhancing the efficiency of the dispensing system operator.

50 Claims, 14 Drawing Sheets

U.S. PATENT DOCUMENTS

| | | | |
|---|---|---|---|
| 3,284,057 | 11/1966 | Duquette | 259/88 |
| 3,350,083 | 10/1967 | Buhrer et al. | 266/38 |
| 3,412,937 | 11/1968 | Chamberlain | 239/142 |
| 3,670,785 | 6/1972 | Heiss et al. | 141/9 |
| 3,797,744 | 3/1974 | Smith | 239/172 |
| 3,930,598 | 1/1976 | Slagle | 222/129.4 |
| 4,090,475 | 5/1978 | Kwan | 222/70 |
| 4,163,523 | 8/1979 | Vincent | 239/305 |
| 4,225,248 | 9/1980 | Para | 366/251 |
| 4,299,500 | 11/1981 | Bassetti | 366/198 |
| 4,372,666 | 2/1983 | Kaufmann | 354/298 |
| 4,380,399 | 4/1983 | Godat et al. | 366/289 |
| 4,407,584 | 10/1983 | Boudin et al. | 366/279 |
| 4,538,222 | 8/1985 | Crain et al. | 364/172 |
| 4,585,148 | 4/1986 | Ito | 222/77 |
| 4,630,654 | 12/1986 | Kennedy, Jr. | 141/83 |
| 4,671,892 | 6/1987 | Bereiter | 252/370 |
| 4,691,850 | 9/1987 | Kirschmann et al. | 222/642 |
| 4,781,312 | 11/1988 | Strazdins | 222/309 |
| 4,792,236 | 12/1988 | Heinis et al. | 366/245 |
| 4,845,965 | 7/1989 | Copeland et al. | 68/17 R |
| 4,898,308 | 2/1990 | Rudick | 222/325 |
| 4,926,390 | 5/1990 | Murzsa | 366/249 |
| 4,941,596 | 7/1990 | Marty et al. | 222/144.5 |
| 4,946,100 | 8/1990 | Flemming et al. | 239/1 |
| 4,967,938 | 11/1990 | Hellenberg | 222/144 |
| 4,976,137 | 12/1990 | Decker et al. | 73/53 |
| 5,020,700 | 6/1991 | Krzywdziak et al. | 222/487 |
| 5,020,917 | 6/1991 | Homan | 366/161 |
| 5,027,284 | 6/1991 | Senghaas et al. | 364/479 |
| 5,056,686 | 10/1991 | Jarrett | 222/129.2 |
| 5,078,302 | 1/1992 | Hellenberg | 222/144 |
| 5,094,543 | 3/1992 | Mursa | 366/247 |
| 5,096,071 | 3/1992 | Neri | 211/71 |
| 5,115,842 | 5/1992 | Crafts et al. | 141/286 |
| 5,119,973 | 6/1992 | Miller et al. | 222/144 |
| 5,153,825 | 10/1992 | Yauk et al. | 364/401 |
| 5,156,194 | 10/1992 | Von Nehring et al. | 141/1 |
| 5,160,198 | 11/1992 | Fillon | 366/198 |
| 5,169,232 | 12/1992 | Fillon et al. | 366/249 |
| 5,199,788 | 4/1993 | Stallings | 366/247 |
| 5,203,366 | 4/1993 | Czeck et al. | 137/3 |
| 5,251,979 | 10/1993 | Larsen | 366/248 |
| 5,310,258 | 5/1994 | Godat et al. | 366/251 |
| 5,335,806 | 8/1994 | Dedoes | 220/358 |
| 5,358,153 | 10/1994 | Caldwell et al. | 222/505 |
| 5,368,388 | 11/1994 | Fillon | 366/245 |
| 5,368,389 | 11/1994 | Dedoes | 366/247 |
| 5,413,257 | 5/1995 | Amberger et al. | 222/472 |
| 5,437,385 | 8/1995 | Fillon | 220/238 |
| 5,454,639 | 10/1995 | Krzywdziak | 366/279 |
| 5,456,534 | 10/1995 | Krzywdziak | 366/249 |
| 5,472,277 | 12/1995 | Dedoes | 366/247 |
| 5,474,211 | 12/1995 | Hellenberg | 222/1 |
| 5,482,370 | 1/1996 | Dedoes | 366/247 |
| 5,493,840 * | 2/1996 | Cane | 141/104 |
| 5,496,109 | 3/1996 | Dedoes | 366/198 |
| 5,498,076 | 3/1996 | Krzywdziak | 366/245 |
| 5,498,077 | 3/1996 | Krzywdzjak et al. | 366/247 |
| 5,503,474 | 4/1996 | Krzywdziak | 366/347 |
| 5,511,878 | 4/1996 | Dedoes et al. | 366/198 |
| 5,533,802 | 7/1996 | Garganese | 366/256 |
| 5,542,761 | 8/1996 | Dedoes | 366/198 |
| 5,586,822 | 12/1996 | Krzywdziak | 366/247 |
| 5,603,426 | 2/1997 | Krzywdziak et al. | 220/324 |
| 5,622,289 | 4/1997 | Dedoes | 222/472 |
| 5,676,463 | 10/1997 | Larsen | 366/251 |
| 5,697,703 | 12/1997 | Lucchetti | 366/198 |
| 5,800,057 | 9/1998 | Lesimple | 366/198 |
| 5,813,760 | 9/1998 | Strong | 366/258 |
| 5,839,825 | 11/1998 | Krzywdziak | 366/247 |
| 5,904,420 | 5/1999 | Dedoes | 366/198 |
| 5,947,598 | 9/1999 | Dedoes | 366/198 |
| 5,988,868 | 11/1999 | Dedoes | 366/198 |
| 6,053,218 * | 4/2000 | Boers | 141/83 |

FOREIGN PATENT DOCUMENTS

| | | | |
|---|---|---|---|
| 2102417 | 4/1972 | (FR) . | |
| 2562874 | 10/1985 | (FR) | B65D/23/04 |
| 2742072 | 1/1998 | (FR) | B01F/15/00 |
| 2 203 059 | 10/1988 | (GB) | B01F/7/16 |

* cited by examiner

SEMI-AUTOMATED AUTOMOTIVE PAINT DISPENSING SYSTEM

CROSS REFERENCE TO RELATED APPLICATIONS

This patent application is related to U.S. patent application Ser. No. 09/189,338, entitled "Paint Container Lid For A Semi-Automated Automotive Paint Dispensing System"; and Ser. No. 09/189,214 entitled "Semi-Automated System For Dispensing, Automotive Paint", both of which were filed on Nov. 10, 1998, assigned to the same assignee as herein, and incorporated herein by reference thereto. In addition, this patent application is related to U.S. patent application Ser. No. 09/416,729, entitled "Lid Member For A Paint Container Useable With A Semi-Automated Automotive Paint Dispensing System" filed on even date herewith, assigned to the same assignee, and incorporated herein by reference thereto; to U.S. patent application Ser. No. 09/416,687, entitled "Fluid Seal For A Pour Spout Of A Paint Container Lid Member" filed on even date herewith, assigned to the same assignee, and incorporated herein by reference thereto; and to U.S. patent application Ser. No. 09/416,728, entitled "Universal Paint Container Lid Member" filed on even date herewith, assigned to the same assignee, and incorporated herein by reference thereto.

TECHNICAL FIELD

This invention relates to mixing paint components, such as colorants, tints and pearls, according to automotive paint formulas. In particular, the present invention is a semi-automated system for dispensing paint components, according to a desired paint formula, that does not require a system operator to manually dispense measured quantities of the paint components.

BACKGROUND OF THE INVENTION

In the automotive body repair industry, paint vendors provide auto body repair businesses, such as body shops and jobbers, with their paint formulas. Generally, these paint formulas are a composition (i.e., mixture) of paint components, such as colorants, tints, pearls, metallics, binders and/or balancers, that, once mixed, produce the desired color of paint to be applied to a repaired vehicle. The paint formulas of the paint vendors are formulated to match the colors that have been applied to vehicles by new car manufacturers over the years. In addition, these paint formulas contain variants, to match the color fading of paint that can occur to a vehicle over years of service. Moreover, the palettes of paint formulas of the paint vendors also contain custom colors (i.e., unconventional colors not typically used by vehicle manufacturers) that may be used to produce special finishes for custom or show cars. Hence, paint vendors provide body shops and jobbers with literally thousands of paint formulas for producing the vast spectrum of colors needed in the automotive body repair industry.

In the past, paint vendors would provide the body shops and jobbers with microfiche containing their paint formulas. Today the paint formulas are stored in computer memory. To determine the particular paint formula for a particular vehicle repair/paint job, a system operator, such as an employee of the body shop or jobber, first obtains the color code from the vehicle. This color code is typically part of the vehicle's identification number. In the case of an unconventional color, to be used to produce a custom paint finish, the code for a particular color is obtained from a catalog. This color code is then entered into the microprocessor of the computer, which accesses the computer memory, and displays, via a monitor, the paint vendor's paint formula which matches the identified vehicle color code.

The paint formulas are displayed according to the weight of the different paint components for mixing specific quantities of the paint formula, and the order in which the displayed paint components are to be mixed. Typically, paint formula mixing quantities are listed in quart, half gallon and gallon sizes, while the weight of the particular paint components needed to mix the desired quantity of paint, are listed in grams to a precision of a tenth of a gram. Generally, the paint components comprising tints, colorants, pearls and/or metallics are mixed first, while the paint components comprising binders and/or balancers are added last. Depending on the desired color, the paint formula can require just a few paint components, or over a dozen paint components, that must be mixed with a great degree of precision, to achieve a perfect color match.

Once the system operator determines that the correct desired paint formula is displayed on the computer monitor, the operator places a paint receptacle on a weigh cell that is linked to the microprocessor of the computer. Generally, a receptacle larger than the quantity of the paint formula to be mixed is used to accommodate any excess paint inadvertently mixed by the operator. With the receptacle on the weigh cell, the weigh cell is zeroed by the operator, to make ready for the process of adding paint components to the receptacle to mix the desired color paint formula. Typically, the various paint components (of which there are dozens) are stored in containers kept within a rack. The rack has a mechanism that periodically stirs the paint components within the containers, so that the various paint components are ready to be dispensed as part of the paint formula mixing process. Typically, these containers are the original quart and gallon sized metal containers within which the paint components are shipped to the body shop or jobber. In metric system countries, these containers are the original one liter and four liter sized metal containers within which the paint components are shipped to the body shop or jobber. The system operator then locates the first listed paint component, of the paint formula to be mixed, and pours, by hand, the paint component into the weigh cell supported paint receptacle, until the weight of the paint component dispensed (i.e., poured) to the receptacle matches what is displayed on the computer monitor. The operator continues along on this course (i.e., hand pouring the paint components from their containers), until the correct weight of all paint components, needed to mix the desired color paint formula, have been added to the paint receptacle atop the weigh cell.

Although the above described system for mixing paint components, according to a paint formula, allows a skilled system operator to adequately recreate paint colors needed for repair/paint jobs, there are some disadvantages to this system. For example, to mix a desired paint formula requires that the paint components be added to the paint receptacle, atop the weigh cell, with a great degree of accuracy. This accuracy, as stated earlier, is typically to a precision of 0.1 grams. For even a highly skilled operator this great degree of precision is difficult to obtain when hand pouring the paint components needed to mix the desired paint formula. It is especially difficult when many paint components must be poured into the paint receptacle in order to duplicate the paint formula.

The most common error on the part of the system operator of the body shop or jobber is over pouring, which is due primarily to the manual labor intensive nature of the paint component dispensing process. Over pouring occurs when the weight of the paint component added to the receptacle atop the weigh cell, exceeds the weight of the component shown on the computer display for the desired paint formula. When this happens, the microprocessor of the computer recalculates the weights of the other paint components that need to be added to the receptacle to compensate for the over poured component. This recalculation is done automatically by the microprocessor since the weigh cell is linked to the computer. Based upon this recalculation, the system operator then needs to re-pour the other paint components to offset the over poured component of the paint formula.

While this re-pouring task may not be difficult when the paint formula only has a few paint components, the re-pouring task is particularly time consuming when there is a great number of components in the paint formula. Specifically, if an over pouring error is made in the last paint component of a series of ten components of a paint formula, then all of the previous nine components may have to be re-poured to compensate. This re-pouring task may be further complicated if another error is made during the re-pouring of the paint components as it may require some components to be re-poured two or three times until the paint formula is finally accurately reproduced. Hence, over pouring errors can be costly to a body shop or jobber because of the additional man hours needed to accurately mix the paint formula.

Not only are over pouring errors expensive because of the additional man hours needed to reproduce the paint formula, over pouring errors are also costly in the amount of additional paint formula that is mixed because of the errors. Automotive paint can cost in excess of $100.00 per quart. An over pouring error of just one pint may translate into an additional cost of $50.00 that a body shop or jobber may have to absorb, unless this additional paint cost can be justified to an automobile collision insurance carrier. Moreover, this additional paint, if not used in the repair/paint job, becomes a hazardous waste that must be disposed of properly, thereby adding still more costs that are attributable to paint component over pouring errors.

There is a need for an improved system for dispensing paint components according to a paint formula. In particular, there is a need for a system for dispensing paint components of a paint formula that substantially eliminates system operator errors, specifically over pouring errors, that can be costly to a body shop or jobber. The paint component dispensing system should be easy to use, so as not to require a highly skilled operator, and should make better use of an operator's time to allow an operator to mix a greater number of paint formulas during a work day. In addition, the paint component dispensing system should comply with all regulations and laws governing the handling and mixing of paint components for the duplication of automotive paint formulas.

SUMMARY OF THE INVENTION

The present invention is a system for dispensing pourable components, such as liquid paint components, from their original containers into a receptacle according to a formula to form a mixture of pourable components, such as a liquid paint mixture. Each original container has a cover element that is movable between a closed state, and an open state wherein the pourable component is dispensed from the original container and into the receptacle. The dispensing system comprises a dispensing apparatus for dispensing the liquid paint component from its original container. The dispensing apparatus includes a support frame, a receiving mechanism coupled to the support frame for releasably receiving the original container, and a dispensing mechanism coupled to the support frame for dispensing the liquid paint component from its original container into a receptacle, such as a paint receptacle. The dispensing apparatus also includes a force applying mechanism for engaging the cover element and applying a force against the cover element for preventing inadvertent leakage of the pourable component from its original container into the receptacle in the closed state of the cover element.

In one embodiment, the dispensing system further includes an apparatus for controlling the dispensing apparatus. The control apparatus includes a weigh cell and a control module coupled to the weigh cell and the dispensing mechanism. The weigh cell supports the paint receptacle to determine the weight of the liquid paint component dispensed into the paint receptacle. The control module controls the amount of the liquid paint component dispensed from its original container into the receptacle based upon information obtained from the weigh cell.

In a further embodiment, the dispensing mechanism of the dispensing apparatus includes an operating device for releasably engaging the movable cover element of the original container of the liquid paint component. The operating device is pivotally movable between a first position and a second position. In the first position, the cover element is in the closed state. In the second position, the cover element is in an opened state and the liquid paint component is dispensed from the original container and into the paint receptacle.

In still a further embodiment, the receiving mechanism for releasably receiving the original container includes first and second mechanisms for engaging first and second portions of the original container of the paint component. The first engaging mechanism is mounted to the support frame so as to be fixed against movement. The second engaging mechanism is mounted to the support frame so as to exhibit only a single-degree-of-freedom of movement. The first and second engaging mechanisms can receive a quart size of the original container of the liquid paint component or a gallon size of the original container of the liquid paint component.

This semi-automated dispensing system, for dispensing liquid paint components from their original containers according to a paint formula to form a liquid paint mixture, virtually eliminates system operator errors, in particular over pouring errors, that can be costly to a body shop or jobber. The semi-automated dispensing system is easy to use, and does not require a highly skilled operator, since operator interface with the dispensing system is substantially limited to identifying the desired paint formula, and loading and unloading the proper containers of the liquid paint components to and from the dispensing apparatus. In the semi-automated dispensing system of the present invention, the operator need no longer manually pour the paint components from their containers. The control module controlled dispensing mechanism of the semi-automated dispensing system automatically dispenses (i.e., pours) the liquid paint components from their containers, thereby ensuring a highly accurate, precision liquid paint component pour. In addition, the paint dispensing system makes efficient use of the operator's time, since the operator is free to perform other duties instead of holding the containers and performing the task of manually pouring the proper amounts of the liquid paint components. This efficiency gain allows the operator to mix a greater number of paint formulas during a work day. Lastly, the semi-automated dispensing system of the present invention complies with all regulations and laws, such as being explosion protected, governing the handling and mixing of liquid paint components for the duplication of automotive paint formulas.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
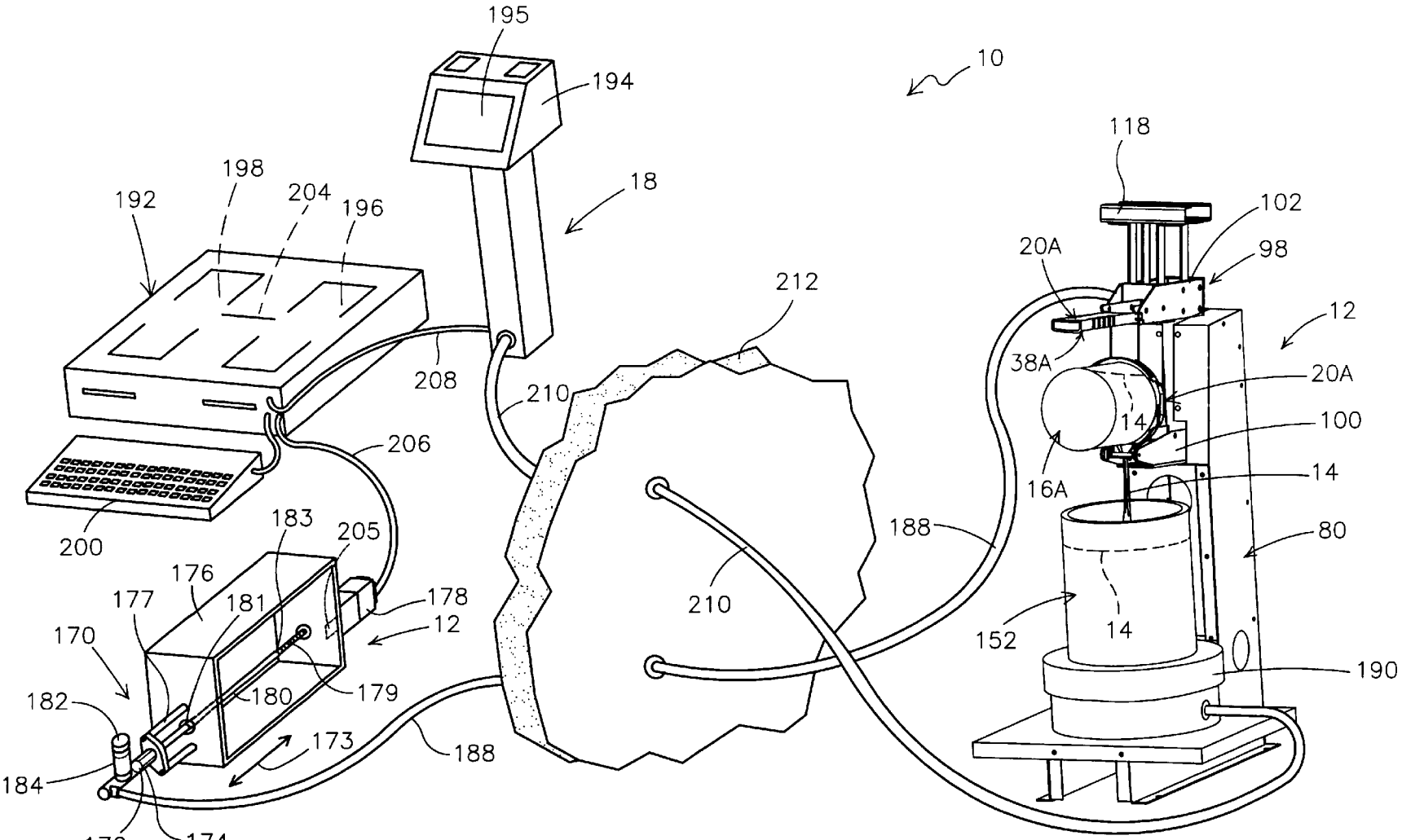
FIG. 1 is a perspective view illustrating a dispensing and control apparatus of a semi-automated system for dispensing liquid paint components from their original containers in accordance with the present invention.
Figure 2:
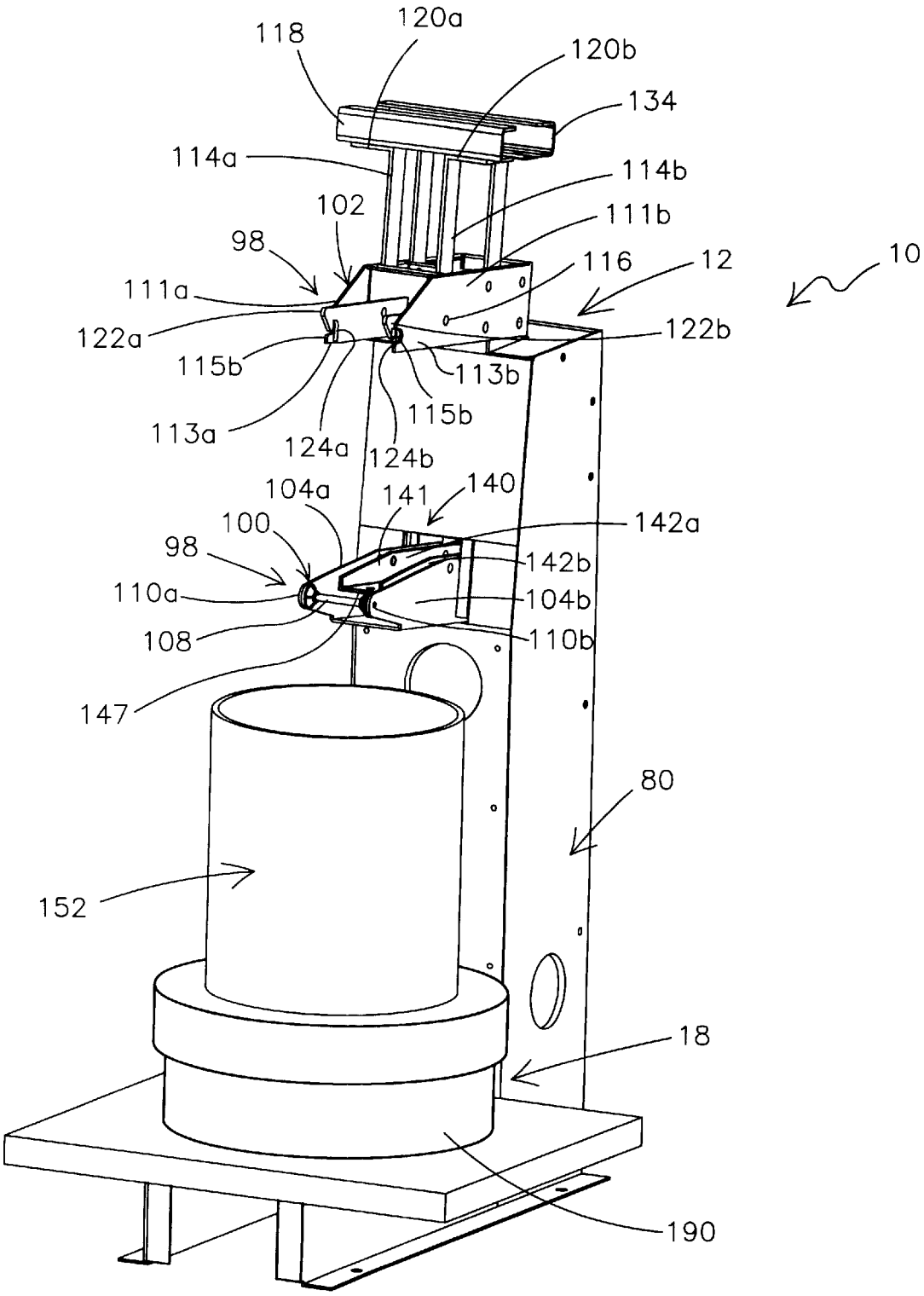
FIG. 2 is an enlarged perspective view better illustrating the dispensing apparatus of the dispensing system of FIG. 1.
Figure 11:
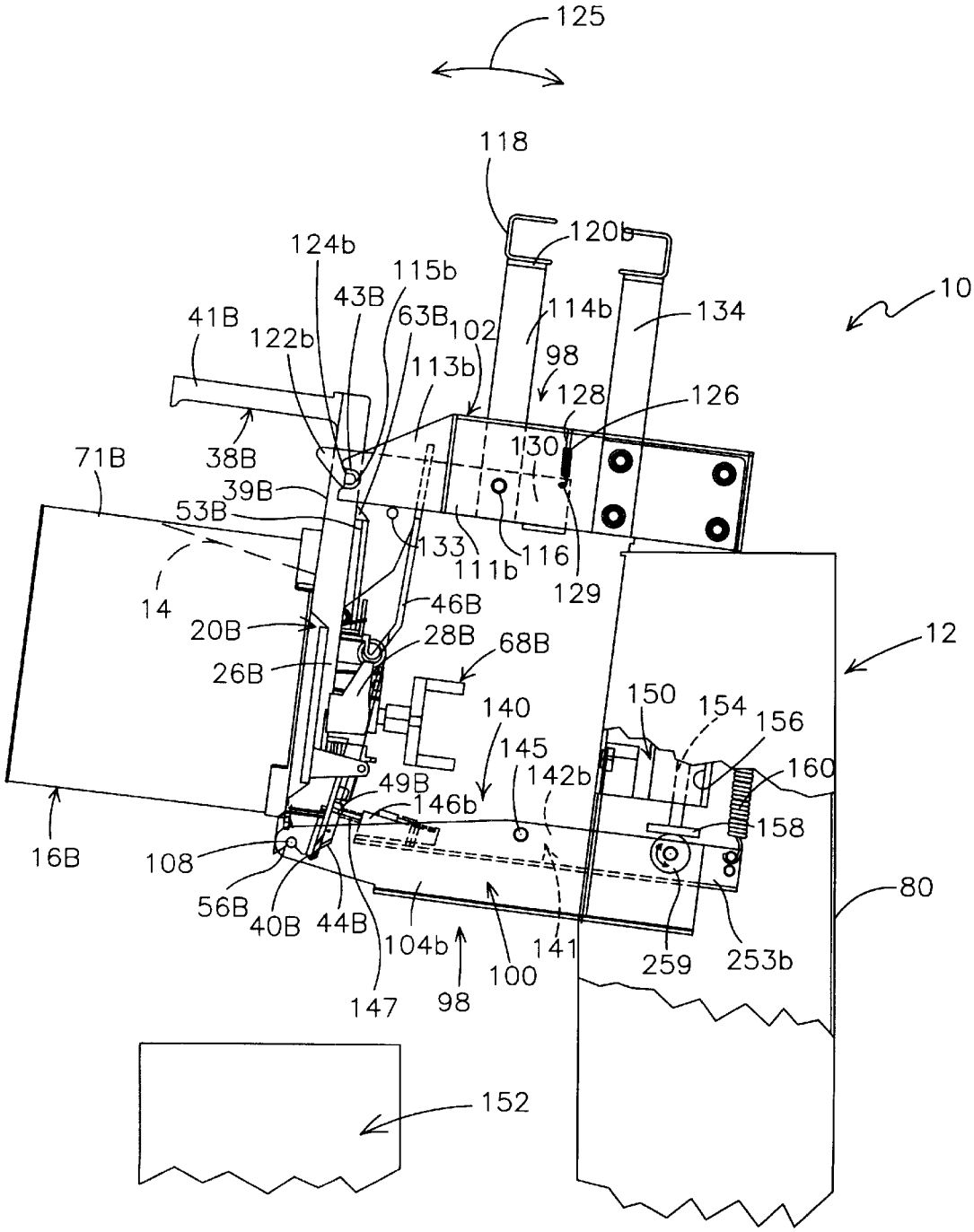
FIG. 11 is a partial side elevational view with some parts omitted for clarity similar to FIG. 7, illustrating a gallon size original container ready for dispensing of a liquid paint component.

A semi-automated dispensing system 10 for dispensing liquid paint components according to a paint formula to form a liquid paint mixture in accordance with the present invention is illustrated generally in FIGS. 1 and 2. The dispensing system 10 generally comprises a dispensing apparatus 12 for dispensing a liquid paint component 14 from its original container 16A and 16B, and a control apparatus 18 for controlling the dispensing apparatus 12. FIGS. 1, 3–8 show the quart size original container 16A having a lid member 20A, while FIG. 11 illustrates the gallon size original container 16B having a lid member 20B. In metric system countries, the lid member 20A fits a one liter size original container and the lid member 20B fits a four liter size original container. The containers 16A and 16B (without the lid members 20A and 20B) are typical cylindrical shaped, metal vessels within which liquid paint components 14, such as tints, colorants, pearls, metallics, binders and balancers (used to mix automotive paint according to a paint formula) are shipped from a liquid paint component manufacturer to customers, such as body shops and jobbers. Beyond their size differences, the quart size and gallon size containers 16A and 16B are substantially identical. Therefore, only the quart size original container will be described with particularity. The lid members 20A and 20B are substantially similar, therefore the quart size lid member 20A will be described with particularity, and only the differences in the gallon size lid member 20B relative to the quart size lid member 20A will be described with particularity.

Figure 3A:
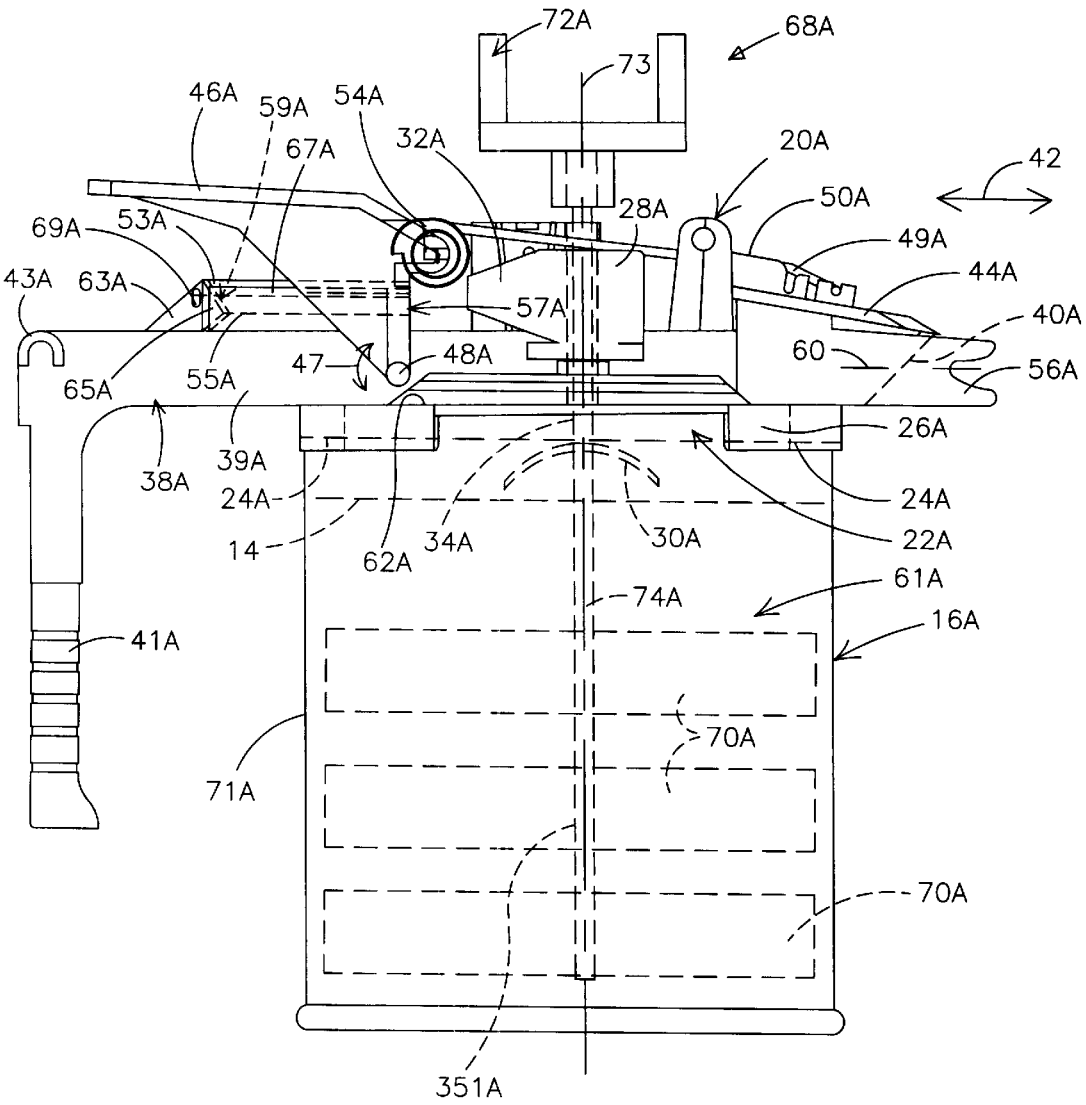
FIG. 3A is a side elevational view of a quart size original paint container and lid member for holding a liquid paint component with a cover element and vent mechanism shown in a closed position.
Figure 3B:
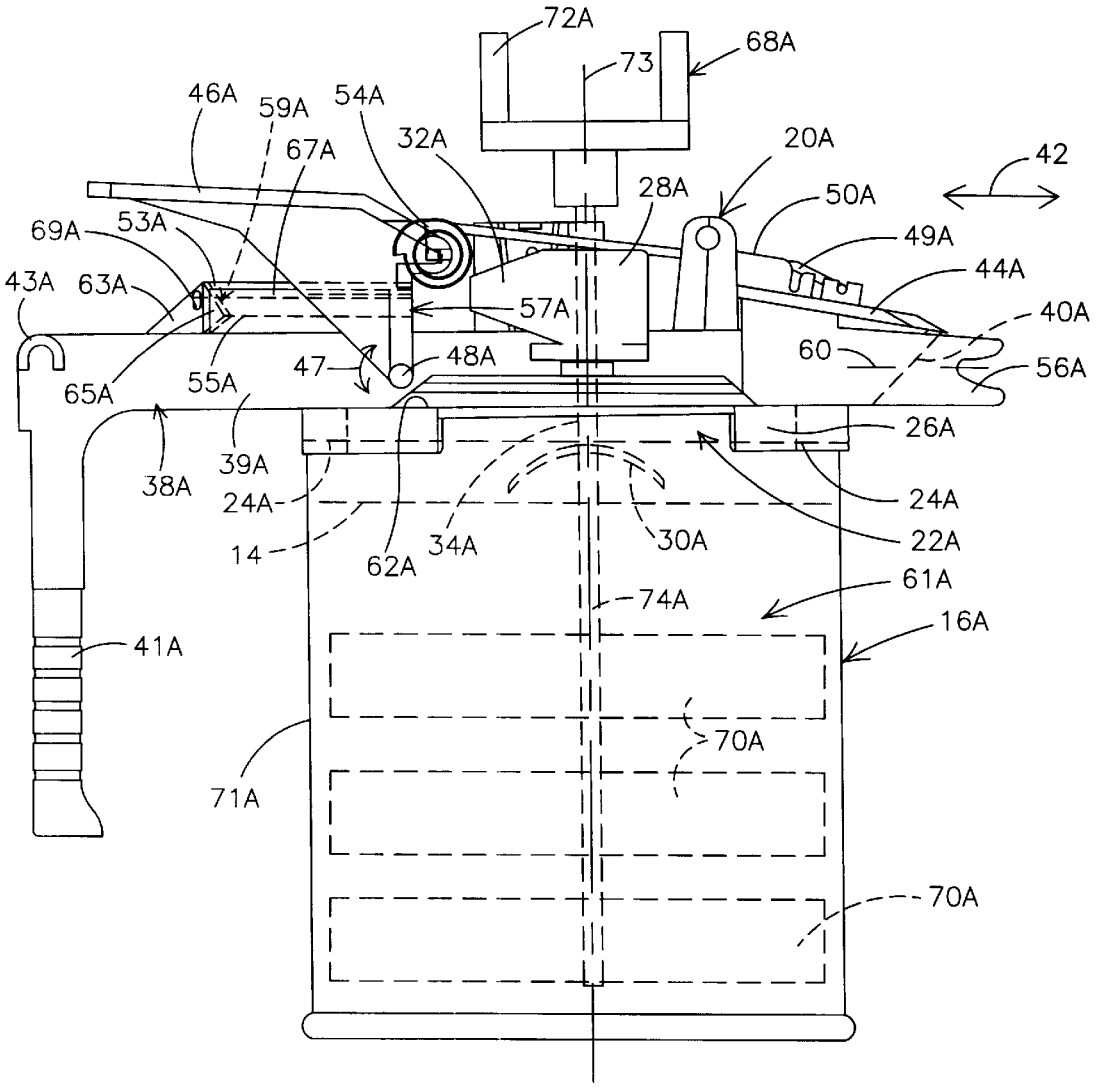
FIG. 3B is a side elevational view similar to FIG. 3A of the quart size original paint container and lid member for holding a liquid paint component with the cover element and vent mechanism shown in an open position.

As seen best in FIGS. 3A and 3B, the original container 16A is cylindrical shaped having an open top 22A defined by a circumferential lip 24A. As seen best in FIGS. 3–5, the lid member 20A includes a base portion 26A adapted to engage and seal the open top 22A of the container 16A to protect the liquid paint component 14 within the container 16A. The base portion 26A of the lid member 20A includes a pair of spaced, pivotable cam lock mechanisms 28A that are used to releasably secure the lid member 20A to the original container 16A. Each of the cam lock mechanisms 28A is defined by a cam element 30A connected to a cam actuator 32A by way of a post member 34A. Pivotally moving the cam actuators 32A by hand, as represented by double headed arrow 36 (see FIG. 4), moves the cam elements 30A into and out of engagement with the lip 24A to secure and release the lid member 20A from the original container 16A.

The lid member 20A further includes a handle 38A, for easy handling of the original container 16A when the lid member 20A is secured thereto. The handle 38A includes a first portion 39A generally parallel to the lip 24A of the original container 16A, a second portion 41A (grasped by a user) that extends substantially perpendicular to the first portion 39, and a pair of oppositely directed dispensing system latch lugs 43A positioned at the intersection the first and second portions 39A, 41A. The purpose of the pair of dispensing system latch lugs 43A will become clear below. In the gallon size lid member 20B, as illustrated in FIG. 11, the pair of oppositely directed dispensing system latch lugs 43B are positioned along the length of the first portion 39B of the handle 38B instead of at the intersection of the first and second portions 39A and 41A as in the quart size lid member 20A. Other than the size differences between the quart size lid member 20A and the gallon size lid member 20B, this different positioning of the dispensing system latch lugs 43A, 43B constitutes the main and only real difference between the lid members 20A and 20B.

The lid member 20A also includes a liquid paint component pour spout 40A. The pour spout 40A is covered by a linearly movable, as represented by double headed directional arrow 42 (see FIGS. 3A and 3B), cover element 44A. The cover element 44A is linearly movable between a closed state (shown in FIG. 3A) and an opened state (shown in FIG. 3B). In the closed state of the cover element 44A, the liquid paint component 14 is prevented from being poured (i.e., dispensed) from the original container 16A through the pour spout 40A. In the opened state of the cover element 44A, the liquid paint component 14 can be poured from the original container 16A through the pour spout 40A by tilting the container 16A using the handle 38A.

Figure 4:
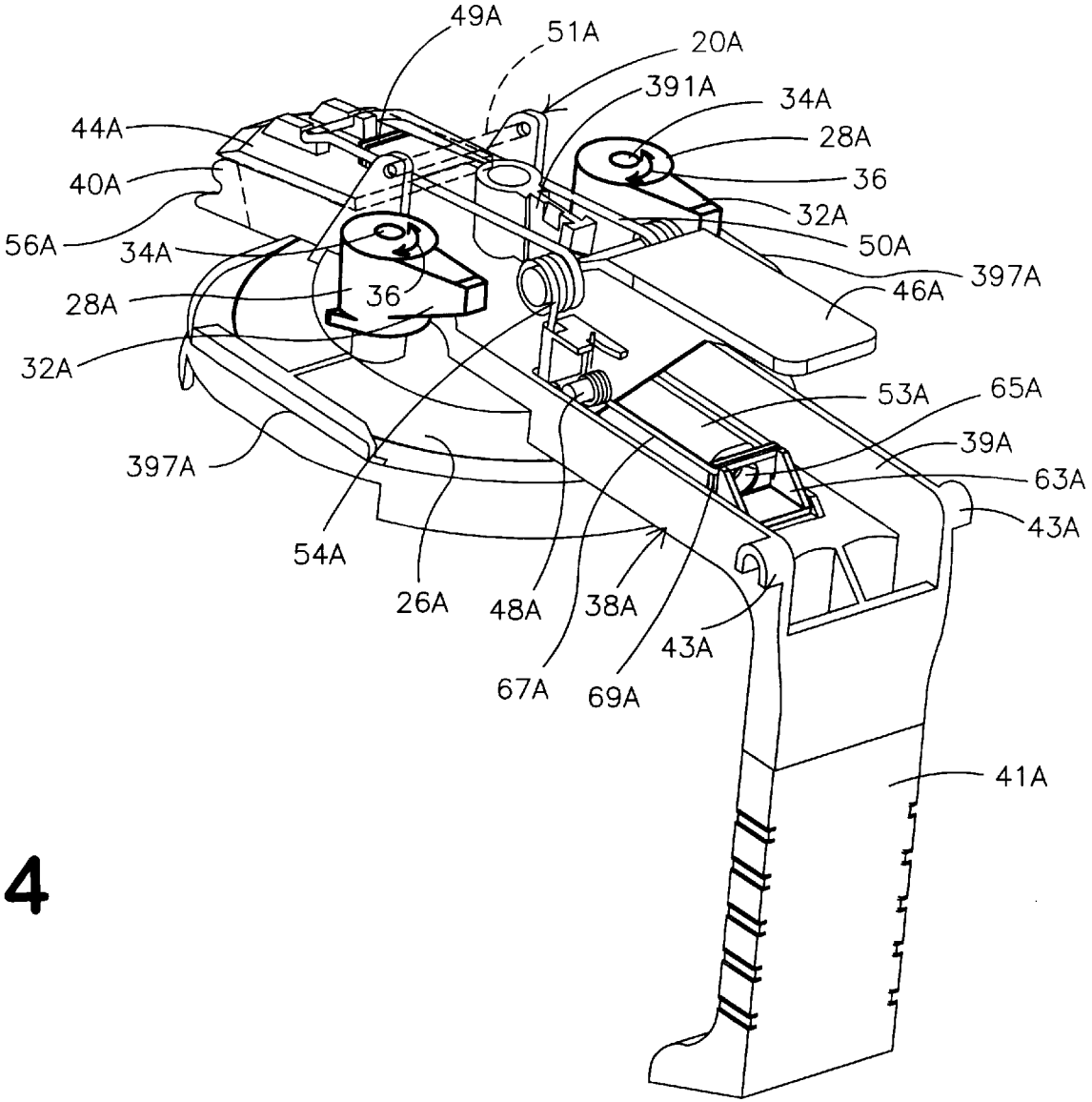
FIG. 4 is a perspective view of the quart size lid member shown in FIG. 3A.
Figure 5:
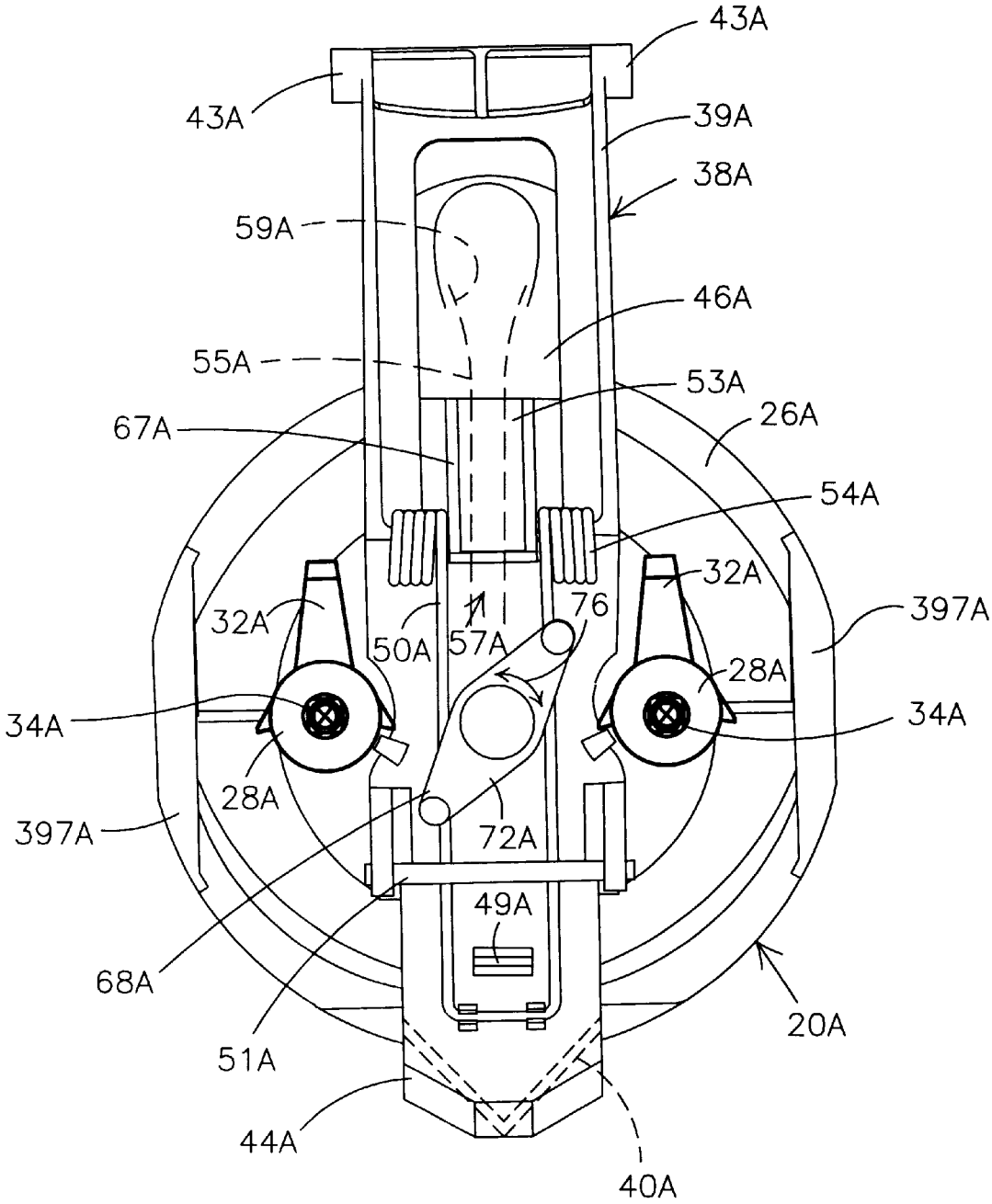
FIG. 5 is top elevational view of the paint container and lid member shown in FIG. 3A.

As seen when comparing FIGS. 3A and 3B, the cover element 44A is movable between its closed and opened states via a thumb actuator 46A that is pivotally secured to the base portion 26A by way of a pivot pin 48A. The thumb actuator 46A is pivotally movable as shown by double headed directional arrow 47. As seen best in FIG. 4, the thumb actuator 46A is connected to the cover element 44A via a wire loop 50A. When the thumb actuator 46A is positioned as shown in FIG. 3A, the cover element 44A is in its closed state. The thumb actuator 46A is biased to this normal position in a known manner by a coil spring element 54A (see FIGS. 3A and 3B). The coil spring element 54A acts between the base portion 26A and the thumb actuator 46A. When the thumb actuator 46A is positioned as shown in FIG. 3B, the cover element 44A is in its opened state. The cover element 44A is moved, from its closed state to its opened state, through the connecting wire loop 50A by pivoting the thumb actuator 46A about the pivot pin 48A against the bias of the spring element 54A. The cover element 44A is allowed to return to its closed state from the opened state by simply releasing the thumb actuator 46A. The lid member 20A also includes a rotatable roller element 51A (see FIGS. 4 and 5) that bears against the wire loop 50A to help maintain a seal between the cover element 44A and the pour spout 40A. As seen in FIGS. 3–5, the cover element 44A also includes a slot 49A the purpose of which will be made clear below.

As seen in FIGS. 3–4, the base portion 26A of the lid member 20A includes a vent member 53A defining a vent passage 55A that has a first open end 57A and an opposite second open end 59A. The vent passage 55A passes through the base portion 26A such that the first open end 57A communicates with an interior region 61A of the original container 16A and the second open end 59A communicates with atmosphere. The second open end 59A is sealable by way of a linearly movable plug element 63A. As seen best when comparing FIGS. 3A and 3B, the plug element 63A is linearly movable between a sealed position (see FIG. 3A) wherein a cone shaped end 65A of the plug element 63A is engaged with the second open end 59A of the vent passage 55A, and an unsealed position (see FIG. 3B) wherein the cone shaped end 65A of the plug element 63A is disengaged from the second open end 59A of the vent passage 55A.

The plug element 63A is linearly movable between the sealed and unsealed positions by actuation of the thumb actuator 46A. The thumb actuator 46A is coupled to the plug element 63A by way of a wire loop element 67A that engages a groove 69A in the plug element 63A. Movement of the thumb actuator 46A between the positions shown in FIGS. 3A and 3B moves the plug element 63A (by way of the wire loop element 67A) between the sealed and unsealed positions. In the sealed position of the plug element 63A, contaminants are prevented from entering the vent passage 55A. In the unsealed position of the plug element 63A (which occurs when the liquid paint component 14 is being dispensed from the original container 16A through the pour spout 40A upon actuation of the thumb actuator 46A), air is allowed to enter the vent passage 55A through the second open end 59A so that the air passes into the interior region 61A of the original container 16A through the second open end 57A to fill the void of the dispensed liquid paint component 14.

As seen best in FIGS. 3–8, the second open end 59A of the vent passage 55A is located radially exterior to the cylindrical side wall 71A of the original container 16A. This location of the second open end 59A of the vent passage 55A prevents the liquid paint component 14 from flowing out of the original container 16A through the vent passage 55A and the subsequent fouling of the exterior portions of the lid member 20A. This undesirable condition is prevented because the second open end 59A of the vent passage 55A is located above the level of the liquid paint component 14 in the dispensing state of the liquid paint component illustrated in FIGS. 8 and 11. The vent passage 55A extends substantially perpendicular to and radially from a central axis 73 of the original container 16A (see FIG. 3A).

As seen best in FIGS. 3 and 4, the lid member 20A further includes an alignment slot 56A positioned at a first portion of the lid member 20A at the pour spout 40A adjacent to the cover element 44A. As seen in FIGS. 3A and 3B, the alignment slot 56A is positioned so as to define a plane 60 that is parallel to an upper surface 62A of the circumferential lip 24A of the original container 16A. The purpose of the alignment slot 56A will become clear below. The alignment slot 56A is formed integrally with the base portion 26A of the lid member 20A.

As seen best in FIGS. 3A and 3B, the lid member 20A further includes a stirring device 68A for stirring the liquid paint component 14 within the original container 16A. The stirring device 68A includes a plurality of paddles 70A connected to a paddle actuator 72A by way of a shaft member 74A. Rotating the paddle actuator 72A, as represented by double headed directional arrow 76, causes rotation of the paddles 70A and stirring of the liquid paint component 14. The paddle actuator 72A is driven (i.e., rotated) by a stirring mechanism (not shown) that is part of a storage rack (not shown) for holding various original containers 16A of liquid paint components 14.

As seen best in FIGS. 1 and 2, the dispensing apparatus 12 of the dispensing system 10 includes a support frame 80. As seen best in FIGS. 2 and 6, the dispensing apparatus 12 further includes a receiving mechanism 98 for releasably engaging the original container 16A, 16B of the liquid paint component 14. The receiving mechanism 98 is defined by first and second engaging mechanisms 100 and 102, respectively.

Figure 6:
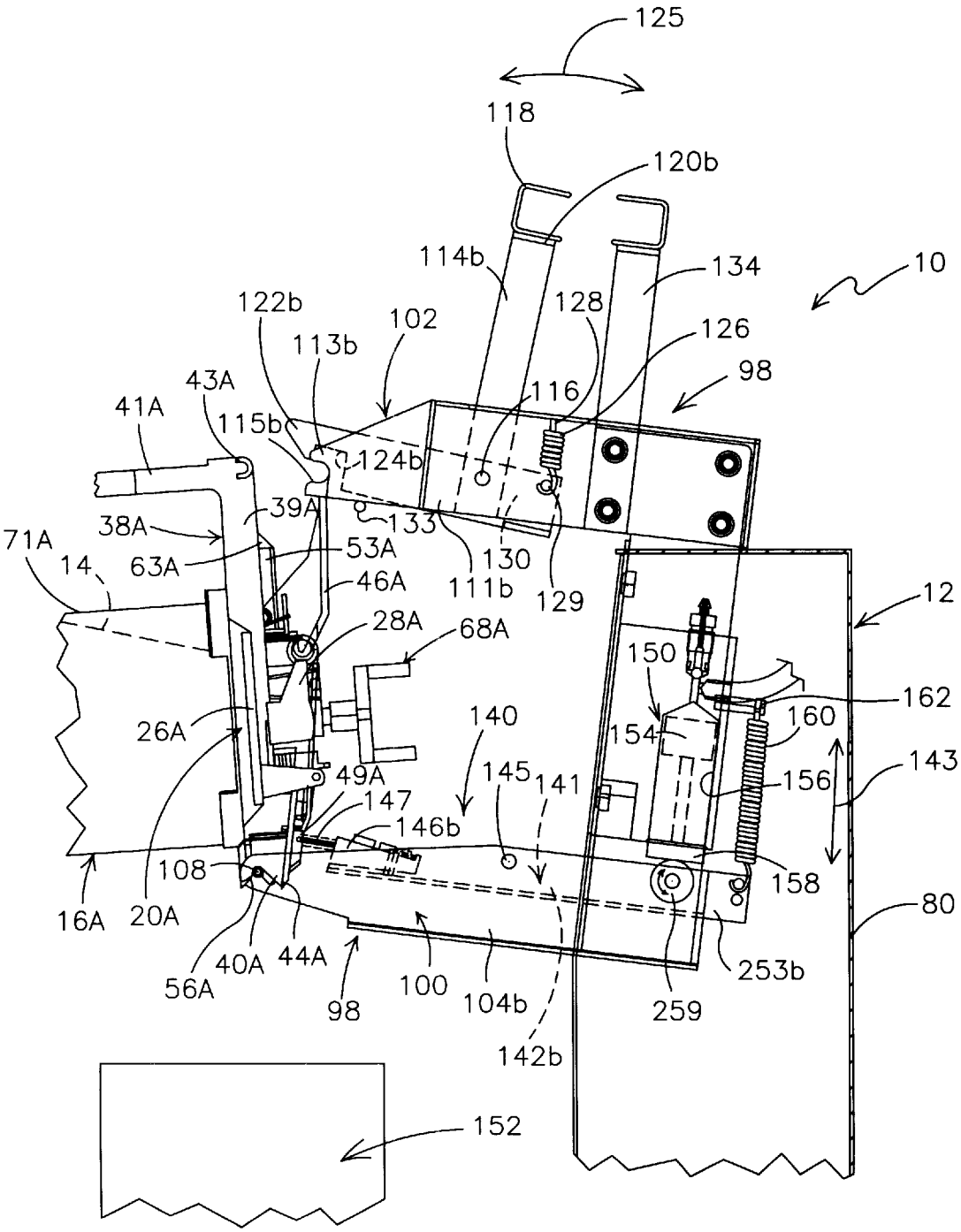
FIG. 6 is partial side elevational view with some parts omitted for clarity of the dispensing apparatus of FIGS. 1 and 2, illustrating a quart,size original container of a paint component being loaded into/unloaded from the dispensing apparatus.
Figure 7:
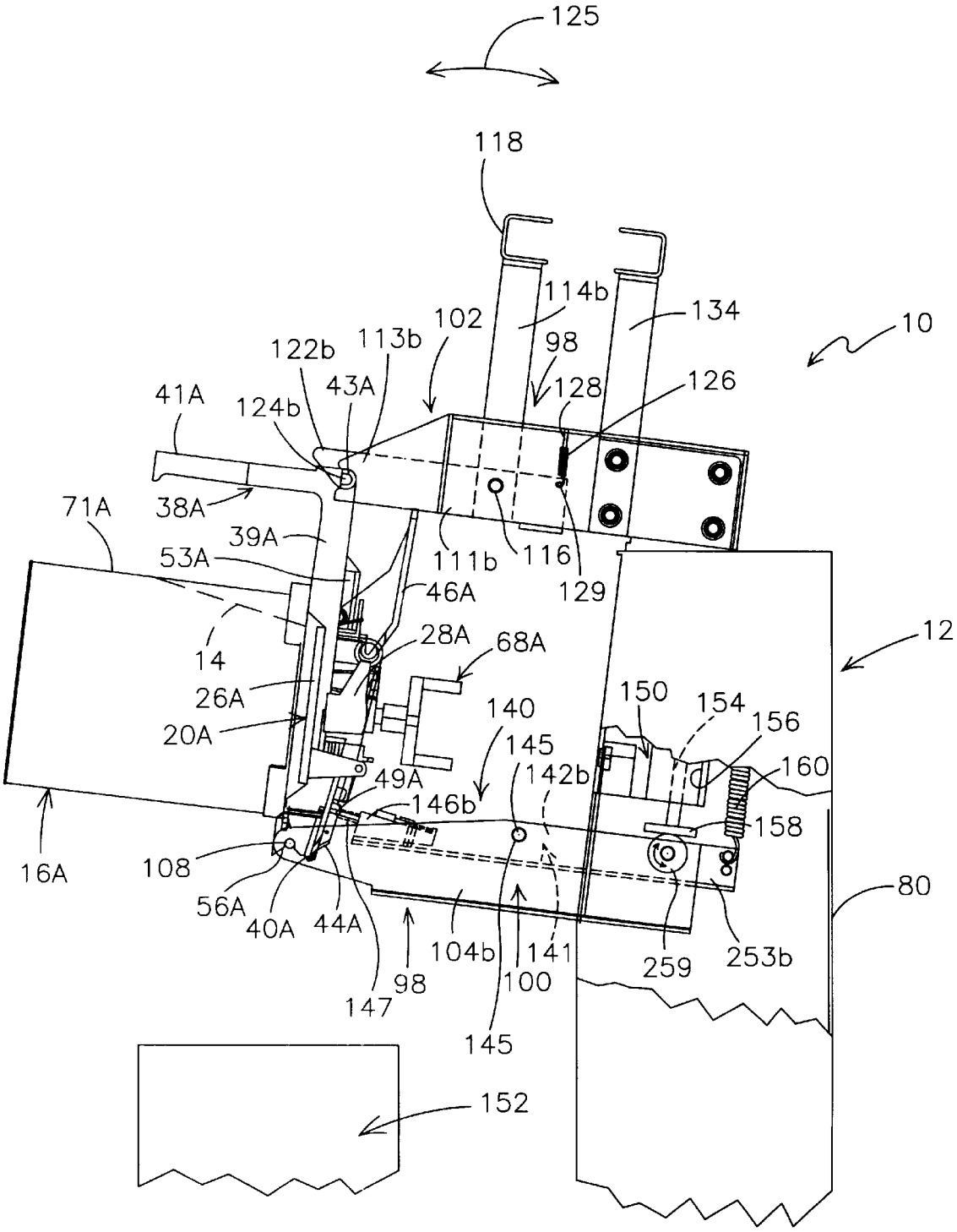
FIG. 7 is a partial side elevational view with some parts omitted for clarity similar to FIG. 6, illustrating the quart size original container ready for dispensing of the liquid paint component.

As seen best in FIG. 2, the first engaging mechanism 100 includes first and second spaced arms 104*a* and 104*b* rigidly mounted to the support frame so as to be fixed against movement relative thereto. A registration rod 108 rigidly connects together the first and second arms 104*a* and 104*b* at their free ends 110*a* and 110*b*. The registration rod 108 is adapted to releasably receive (i.e., engage) the alignment slot 56A of the lid member 20A. As seen in FIG. 6, interengagement of the alignment slot 56A with the registration rod 108 mounts (i.e., secures) and aligns a first portion of the container 16A and lid member 20A combination to the receiving mechanism 98 of the dispensing apparatus 12.

The second engaging mechanism 102 includes first and second spaced plates 111*a* and 111*b* fixed to an upper end of the support frame 80. Free ends 113*a* and 113*b* of the plates 111*a*, 111*b* include latch slots 115*a* and 115*b*, respectively. The second engaging mechanism 102 further includes first and second spaced L-shaped arms 114*a* and 114*b* pivotally mounted to the support frame 80 via a pivot pin 116. A handle member 118 rigidly connects together the first and second L-shaped arms 114*a* and 114*b* at their first ends 120*a* and 120*b*. Second ends 122*a* and 122*b* of the first and second L-shaped arms 114*a* and 114*b* include latching notches 124*a* and 124*b*. The latching notches 124*a* and 124*b* are adapted to releasably receive (i.e., engage) the latch lugs 43A on the handle 38A of the lid member 20A for the original container 16A to secure the latch lugs 43A in the latch slots 115*a* and 115*b* of the plates 111*a*, 111*b*. The L-shaped arms 114*a* and 114*b* of the second engaging mechanism 102 are pivotally movable as a unit, as represented by double headed arrow 125, between an unlatched state, wherein the original container 16A of the liquid paint component 14 can be engaged with and disengaged from the first and second engaging mechanisms 100 and 102 (shown in FIG. 6); and a latched state, wherein the original container 16A is securely held between the first and second engaging mechanisms 100 and 102 (shown in FIG. 7). As such the L-shaped arms 114*a* and 114*b* (i.e., the second engaging mechanism 102) exhibits only a single-degree-of-freedom of movement (i.e., pivotal movement only) relative to the support frame 80 and the first engaging mechanism 100 (i.e., the first and second spaced arms 104*a* and 104*b*). A tension spring element 126 is coupled between a mounting peg 128 of the support frame 80 and a mounting peg 129 of an extension arm 130 on the L-shaped arm 114*a*. The tension spring element 126 biases the L-shaped arms 114*a* and 114*b* defining a portion of the second engaging mechanism 102 to the latched state against the stop 133. A handle/stop member 134 limits movement of the L-shaped arms 114*a* and 114*b* in a clockwise direction as viewed in FIG. 6.

Figure 9A:
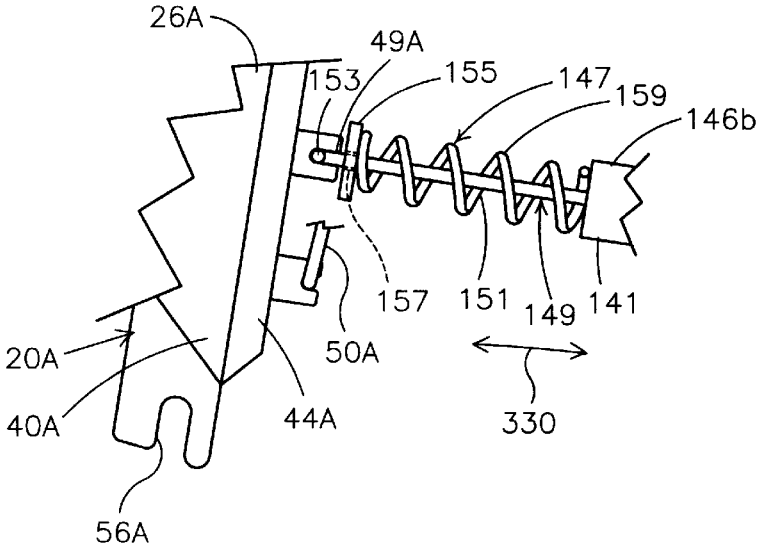
FIG. 9A is an enlarged, partial side elevational view of a force applying mechanism for a cover element of the lid member with the cover element shown in a closed position corresponding to FIG. 7.
Figure 9B:
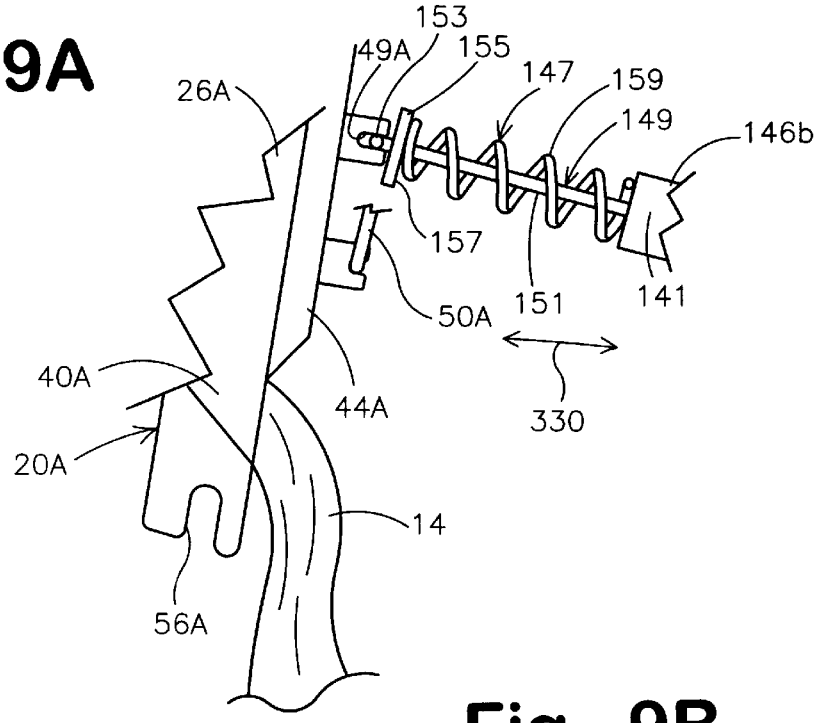
FIG. 9B is an enlarged, partial side elevational view similar to FIG. 9A with the cover element shown in an open position corresponding to FIG. 8.
Figure 10:
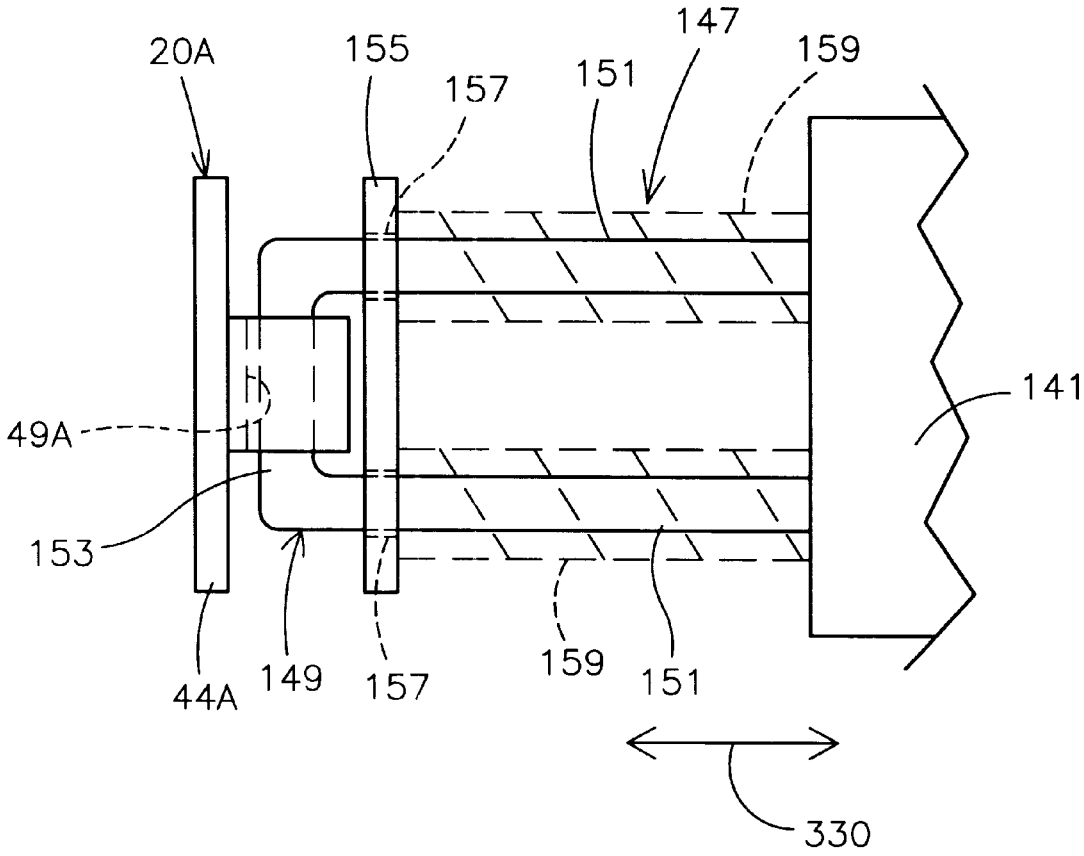
FIG. 10 is an enlarged, partial top elevational view of the force applying mechanism shown in FIG. 9.

As seen best in FIGS. 2 and 6, the dispensing apparatus 12 of the dispensing system 10 further includes dispensing mechanism 140 mounted to the support frame 80 for moving the cover element 44A of the lid member 20A between its closed and open states. The dispensing mechanism 140 includes outwardly extending, first and second arms 142*a* and 142*b* that define an operating device 141 pivotally movable, as a unit, as represented by double headed directional arrow 143 (FIG. 8), relative to the support frame 80 about an axle 145. The free ends 146*a* and 146*b*, of the first and second arms 142*a* and 142*b*, include a force applying mechanism 147 (seen best in FIGS. 9–10) adapted to releasably engage the slot 49A in the cover element 44A on the lid member 20A (see FIGS. 6–10). The force applying mechanism 147 includes U-shaped wire member 149 having legs 151 and a connecting portion 153. The legs 151 are rigidly mounted to the operating device 141. As seen best in FIGS. 9 and 10, the connecting portion 153 is releasably received within the slot 49A of the cover element 44A. The force applying mechanism 147 further includes a force applying plate member 155 that is linearly movable relative to the U-shaped wire member 149 as represented by double headed arrow 330. The force applying plate member 155 includes apertures 157 that freely receive the legs 151 of the U-shaped wire member 149 to permit movement of the plate member 155 along the legs 151. A compression spring 159 surrounds each of the legs 151 and acts between the operating device 141 and the plate member 155 to provide a biasing force urges the plate member 155 against the cover element 44A to prevent inadvertent leakage of the liquid paint component 14 from the pour spout 40A of the lid member 20 atop the original container 16A when the original container 16A is mounted in the dispensing system 10 (see FIG. 7) and the cover element 44A is in a closed position.

Figure 8:
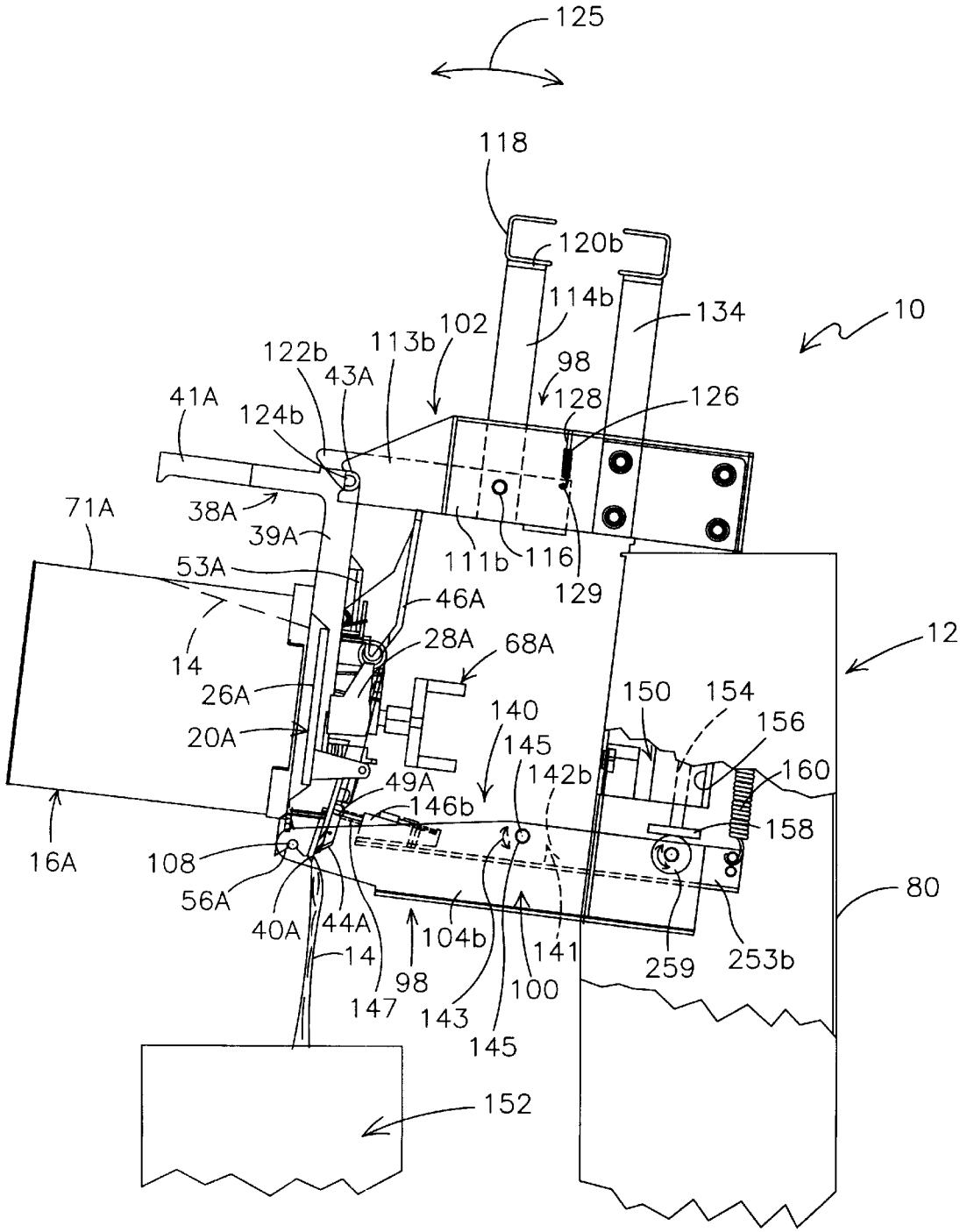
FIG. 8 is a partial side elevational view with some parts omitted for clarity similar to FIG. 7, illustrating the liquid paint component being dispensed from its quart size original container.

As seen in FIG. 8, with the connecting portion 153 of the force applying mechanism 147 of the operating device 141 engaged with the slot 49A of the cover element 44A, a transit mechanism 150 of the dispensing mechanism 140 can pivotally move the operating device 141 between a first position and a second position. In the first position of the operating device 141 (FIG. 7), the cover element 44A of the lid member 20A is in its closed state which prevents the liquid paint component 14 from being dispensed from the original container 16A with the help of the force applying mechanism 147. In the second position of the operating device 141 (FIG. 8), the cover element 44A is in its opened state which allows the liquid paint component 14 to be dispensed (i.e., poured) from the original container 16A into a paint receptacle 152 (FIG. 1).

As set forth previously, the handles 38A and 38B of each of the lid members 20A and 20B include the latch lugs 43A, 43B. The difference in positioning of these latch lugs 43A and 43B between the quart size lid member 20A and the gallon size lid member 20B results in the latch lugs 43A, 43B being the same position relative to the alignment slot 56A, 56B. This allows the receiving mechanism 98 (defined by the first and second engaging mechanisms 100 and 102) and the dispensing mechanism 140 to accommodate quart size original containers 16A (FIGS. 6–8) and gallon size original containers 16B (FIG. 11).

As seen best in FIGS. 6, the transit mechanism 150 of the dispensing mechanism 140 includes a piston member 154 linearly movable, along directional arrow 143 (FIG. 6), relative to a cylinder member 156. Opposite ends 253*a* and 253*b* of the first and second arms 142*a* and 142*b* (defining the operating device 141) are coupled to the piston member 154. A pad member 158 of the piston member rides on a roller member 259 rotatably mounted to the arms 142*a*, 142*b*. Therefore movement of the piston member 154 within the cylinder member 156 causes the operating device 141 to move between its first and second positions. Tension spring elements 160 are coupled between the opposite ends 253*a*, 253*b* of the arms 142*a*, 142*b* and a mounting member 162 on the support frame 80. The tension springs 160 bias the operating device 141 to its first position (also known as the primary position of the piston member 154).

As seen in FIG. 1, a drive mechanism 170 of the transit mechanism 150 moves the piston member 154 relative to the cylinder member 156. The drive mechanism 170 includes a piston member 172 linearly movable, along double headed directional arrow 173, relative to a cylinder member 174 mounted to a frame 176 via bracket structure 177. A drive motor, such as a stepper motor 178, is also mounted to the frame 176. The drive motor 178 includes a drive screw 179 that is telescopically received within a drive tube 180 that is secured at one end to the piston member 172. The drive tube 180 is slidably received within a bearing 181 of the frame 176 to allow movement of the drive tube 180, and the piston member 172 therewith, relative to the frame 176, drive motor 178 and cylinder member 174. An opposite end of the drive tube 180 includes a drive nut 183 that threadably receives the drive screw 179 of the stepper motor 178.

Operation of the stepper motor 178 turns the drive screw 179 within the drive nut 183. This in turn moves the drive tube 180 and therewith the piston member 172 within the cylinder member 174 along directional arrow 173. A fluid reservoir 182 containing a hydraulic fluid 184 is in fluid communication with the cylinder member 174. A fluid line 188 couples the fluid reservoir 182 to the cylinder member 156. In operation, movement of the piston member 172, via the stepper motor 178, forces hydraulic fluid 184 to move to and from the cylinder member 174 and the fluid reservoir 182 through the line 188 then into and out of the cylinder member 156 to move the piston member 154. Movement of the piston member 154, via the above described hydraulic fluid pressure, in turn moves the operating device 141 which in turn moves the cover element 44A of the lid member 20A between its opened and closed states.

Figure 12:
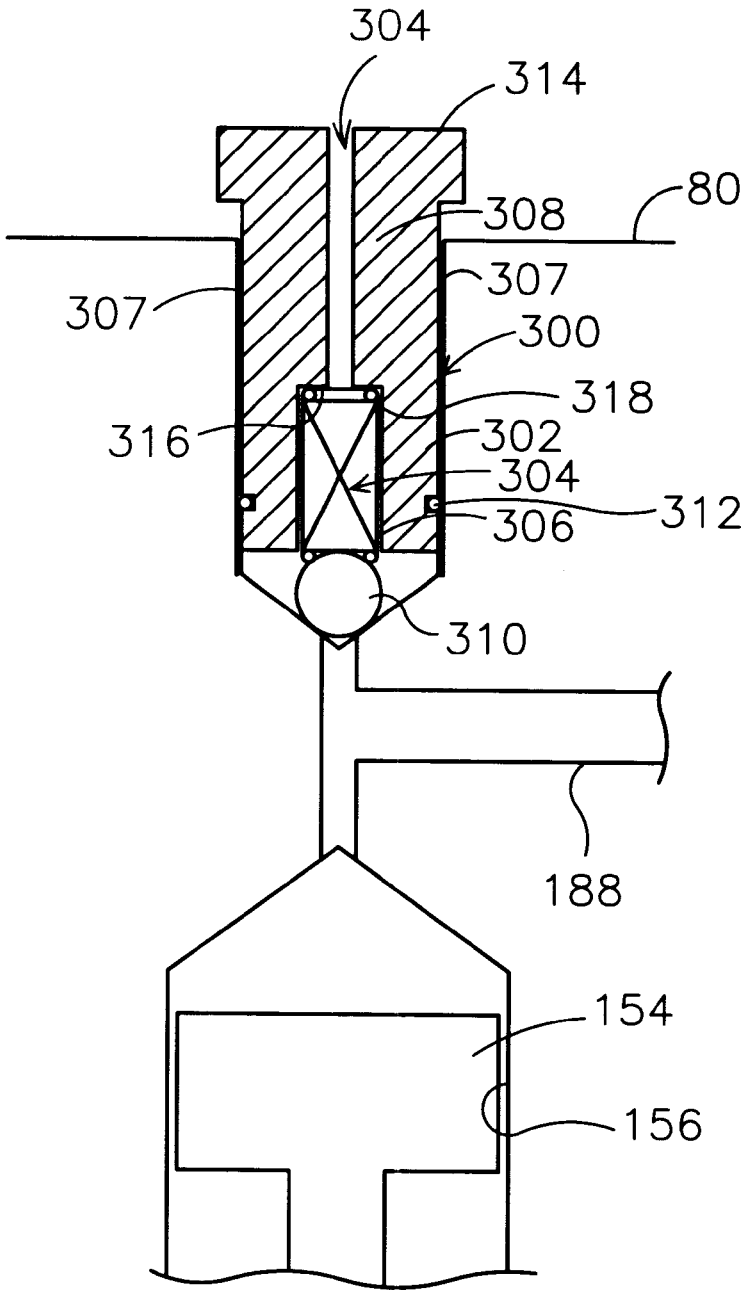
FIG. 12 is a partial side elevational view of an automatic bleeder valve of the semi-automated dispensing system of the present invention with the valve shown in a closed position.
Figure 13:
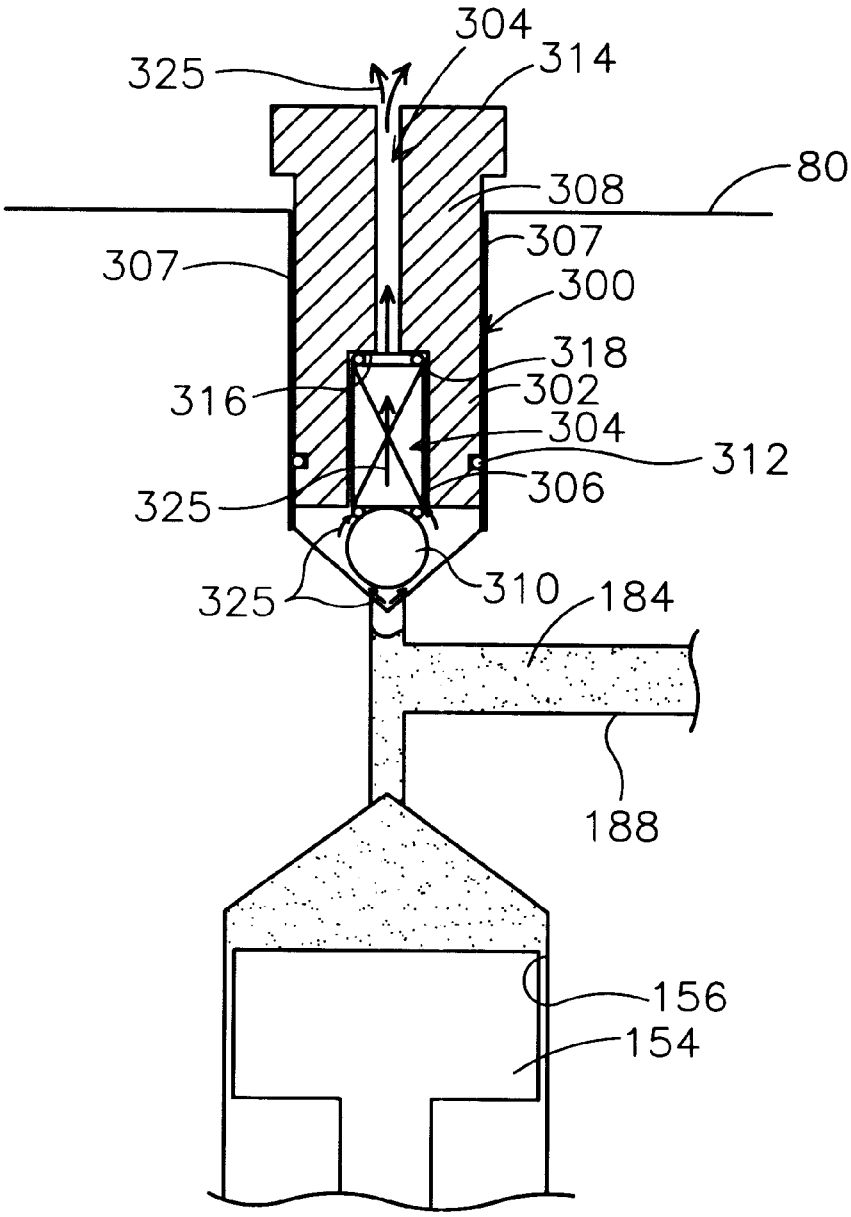
FIG. 13 is a partial side elevational view similar to FIG. 12 illustrating the automatic bleeder valve in an opened position.

As seen in FIGS. 12 and 13, the dispensing system 10 includes an automatic bleeder valve 300 to aid in initially filling the dispensing system 10 with hydraulic fluid 184. The hydraulic bleeder valve 300 includes a body member 302 defining an orifice 304 that extends through the body member 302 from a first end 306 to a second end 308. The orifice 304 is in fluid communication with the fluid line 188 and the cylinder member 156. A linearly movable ball valve 310 is positioned at the first end 306 of the body member 302. The ball valve 310 is movable between a first position, wherein the ball valve 310 forms a fluid seal and air/hydraulic fluid 184 is prevented from passing into the orifice 304 (see FIG. 12), and a second position wherein the ball valve 310 acts as a check valve and air and/or hydraulic fluid 184 may pass through the orifice 304 from the first end 306 to the second end 308 (see FIG. 13). The body member 302 threadably engages the support frame 80 via threads 307 so as to be movable linearly relative thereto. The body member 302 includes a nut 314 at the second end 308 used to twist the body member 302 to move the body member 302 relative to the support frame 80. Near the first end 306, the body member 302 includes an O-ring seal member 312 to prevent air/hydraulic fluid 184 from flowing past the body member 302 through the threads 307. An inner end 316 of the body member 302 bears against a compression spring 318 that in turn bears against the ball valve 310.

In operation, to fill the cylinder member 156 with hydraulic fluid 184, the body member 302 is loosened using the nut 314 which decompresses the spring 318 and allows the ball valve 310 to move to the position shown in FIG. 13. Hydraulic fluid 184 is then pumped through the fluid line 188 from the reservoir 182 via the piston member 172 of the drive mechanism 170. The hydraulic fluid 184 passes from the fluid line 188 into the cylinder member 156 primarily due to gravity and because this is the fluid path of least resistance. Air within the fluid line 188 and the cylinder member 156 is automatically bled out (by the introduction of the hydraulic fluid 184) through the automatic bleeder valve 300. The air passes around the ball valve 310, through the spring 318 and through the orifice 304 as represented by the arrows 325 in FIG. 13. The fluid line 188 and cylinder member 156 are full of hydraulic fluid 184 when the hydraulic fluid 184 passes out of the orifice 304. The body member 302 is then tightened using the nut 314 which causes the inner end 316 of the body member 302 to bear against the spring 318 which compresses the spring against the ball valve 310 sealing off the orifice 304 of the bleeder valve 300, thereby completing the filling process (see FIG. 12).

As seen in FIG. 1, the control apparatus 18 of the dispensing system 10 includes a weigh cell 190 for supporting the paint receptacle 152 and a control module 192. The weigh cell 190 determines the weight of the liquid paint component dispensed (i.e., poured) from the original container 16A into the paint receptacle 152. The control module 192 includes a display monitor device 194 having a display 195, a microprocessor device 196, a data storage device 198 and a user interface device, such as a keyboard 200. The keyboard 200 is coupled to the microprocessor device 196 via a communication line 202. The microprocessor device 196 and the data storage device 198 are linked through a communication line 204. The microprocessor device 196 is linked to the stepper motor 178 and to a sensor 205 for monitoring the position of the drive screw 179 through the communication line 206. The microprocessor device 196 is linked to the display monitor device 194 through communication line 208 and is further linked to the weigh cell 190 via communication line 210. Since the control module 192 (i.e., microprocessor device 196) is linked to the stepper motor 178 and the sensor 205, the control module 192 can control operation of the stepper motor 178, and thereby movement of the piston members 172 and 154, and hence movement of the cover element 44A to dispense the liquid paint component 14 from the original container 16A. In addition, since the control module 192 is further linked to the weigh cell 190, the control module 192 can control the amount (i.e., the weight) of the liquid paint component 14 dispensed from its original container 16A to the paint receptacle 152 (atop the weigh cell 190) based upon data (i.e., information) obtained from the weigh cell 190. Moreover, since the control module 192 (i.e., the data storage device 198) stores the paint formulas, the control module 192 can determine which liquid paint components 14 and the weights of these components needed to duplicate a particular paint formula and can control the dispensing mechanism 140 in accordance therewith.

As seen in FIG. 1, the control module 192 and the drive mechanism 170 are positioned in another room such that the communication line 210 and the fluid line 188 pass through a wall 212 so as to provide explosion protection for the dispensing system 10. Alternatively, one or more of the display monitor device 194, the microprocessor device 196, and the keyboard 200 could be located next to the dispensing system 10 provided that these components are explosion protected.

In operation, to mix a particular paint formula, the operator of the semi-automated dispensing system 10 first accesses the control module 192 through the keyboard 200 to call up the desired paint formula using the microprocessor device 196 the data storage device 198. The paint formula (i.e., the liquid paint components 14) is then displayed on the display 195 of the display monitor device 194. The operator then loads the first container 16A, 16B of the needed liquid paint components into the dispensing apparatus 12.

As seen in FIG. 6, to mount (i.e., load) an original container 16A of a liquid paint component 14 to the receiving mechanism 98 of the dispensing apparatus 12, the operator of the dispensing system 10 first needs to pivot the second engaging mechanism 102 (defined by the L-shaped arms 114*a*, 114*b*) clockwise (as viewed in FIG. 6) from its normal latched state to its unlatched state, against the handle/stop member 134 mounted to the support frame 80. The operator, while gripping both the handle member 118 and the handle/stop member 134 to hold the second engaging mechanism 102 in its unlatched state (against the bias of the spring element 126), then engages the alignment slot 56A of the lid member 20A with the registration rod 108 of the first engaging mechanism 100 (FIG. 6). Next, while still holding the second engaging mechanism 102 in its unlatched state, the operator pivots the container 16A and lid member 20A combination clockwise (as viewed in FIG. 6) until the connecting portion 153 of the force applying mechanism 147 of the operating device 141 is fully seated in the slot 49A of the cover element 44A, and the latch lugs 43A are fully seated in the latch slots 115*a*, 115*b* of the plates 111*a*, 111*b*. With the alignment slot 56 now fully seated on the registration rod 108, the connecting portion 153 of the operating device 141 fully seated in the slot 49A of the cover element, and the latch lugs 43A fully seated in the latch slots 115*a*, 115*b*, the operator pivots the second engaging mechanism 102 counter-clockwise to its latched state, so that the latching notches 124*a* and 124*b* engage the latch lugs 43A of the lid member 20A securing the original container 16A lid member 20A combination to the receiving mechanism 98 the dispensing apparatus 12. To remove the container 16A for the dispensing apparatus 12, this above described process is simply reversed.

The operator then starts the dispensing process using the keyboard 200 of the control module 192. Since the control module 192 (i.e., microprocessor device 196) is linked to the stepper motor 178 and the sensor 205, the control module 192 controls operation of the stepper motor 178, and thereby movement of the piston members 154 and 172, and hence movement of the cover element 44A to dispense (i.e., pour) the liquid paint component 14 from the original container 16A into the paint receptacle 152. The arrangement of the second engaging mechanism 102 and the latch lugs 43A prevents movement of the cover element 44A from inadvertently disengaging the alignment slot 56A from the first registration rod 108. The weight of the liquid paint component 14 dispensed into the paint receptacle 152 is monitored by the control module 192 through the weigh cell 190, thereby ensuring an accurate liquid paint component pour. Once the first liquid paint component 14 is poured, its container 16A, 16B is removed and is replaced with the next paint component container 16A, 16B and so on, until all paint components 14 of the paint formula have been added to the paint receptacle 152, thereby completing the paint formula mixing process.

This semi-automated dispensing system 10, for dispensing liquid paint components 14 from their original containers 16A, 16B according to a paint formula to form a liquid paint mixture, virtually eliminates system operator errors, in particular over pouring errors, that can be costly to a body shop or jobber. The semi-automated dispensing system 10 is easy to use, and does not require a highly skilled operator, since operator interface with the dispensing system 10 is substantially limited to identifying the desired paint formula, and loading and unloading the proper containers 16A, 16B of the liquid paint components 14 to and from the dispensing apparatus 12. In the semi-automated dispensing system 10 of the present invention, the operator need no longer manually pour the paint components 14 from their containers 16A, 16B. The control module 192 controlled dispensing mechanism 140 of the semi-automated dispensing system 10 automatically dispenses (i.e., pours) the liquid paint components 14 from their containers 16A, 16B, thereby ensuring a highly accurate, precision liquid paint component pour. In addition, the paint dispensing system 10 makes efficient use of the operator's time, since the operator is free to perform other duties instead of holding the containers 16A, 16B and performing the task of manually pouring the proper amounts of the liquid paint components 14. This efficiency gain allows the operator to mix a greater number of paint formulas during a work day. Lastly, the semi-automated dispensing system 10 of the present invention complies with all regulations and laws, such as being explosion protected, governing the handling and mixing of liquid paint components 14 for the duplication of automotive paint formulas.

Although the present invention has been described with reference to preferred embodiments, workers skilled in the art will recognize that changes may be made in form and detail without departing from the spirit and scope of the invention. For example, although the semi-automated dispensing system 10 has been described as useable to dispense liquid automotive paint components 14 from their original containers 16A and 16B, the dispensing system can be used to dispense other pourable components, such as primers, thinners and liquid or powdered chemicals. In particular the dispensing system 10 could be used in laboratory or pharmaceutical organizations to accurately dispense liquid and powdered chemicals according to a desired formula.

What is claimed is:

1. A system for dispensing pourable components from their original containers into a receptacle according to a formula to form a mixture of pourable components, each original container having a cover element that is movable between a closed state, and an opened state wherein the pourable component is dispensed from the original container and into the receptacle, the dispensing system comprising:

a dispensing apparatus for dispensing a pourable component from its original container, the dispensing apparatus including:

a support frame;

receiving means, coupled to the support frame, for releasably receiving the original container; and dispensing means, coupled to the support frame, for moving the cover element between the closed state, and the open state for dispensing the pourable component from its original container into the receptacle, the dispensing means including:

an operating device movable between a first position, wherein the cover element is in the closed state, and a second position, wherein the cover element is in the opened state and the pourable component is dispensed from the original container and into the receptacle; and force applying means mounted to the operating device for engaging the cover element and applying a force against the cover element for preventing inadvertent leakage of the pourable component from its original container into the receptacle in the closed state.

2. The dispensing system of claim 1 wherein the pourable component is a liquid paint component, the receptacle is a paint receptacle, the formula is a paint formula, and the mixture of pourable components is a liquid paint mixture.

3. The dispensing system of claim 1 wherein the operating device includes a pivot member for pivotally mounting the operating device to the support frame so as to be pivotally movable between the first and second positions.

4. The dispensing system of claim 3 wherein the operating device includes a first end that includes the force applying means, and a second end, and wherein the force applying means includes:

an engagement element for releasably engaging a corresponding engagement feature on the cover element;

a force applying member movable relative to the engagement element and releasably engageable with the cover element; and force means acting on the force applying member for providing a force that releasably holds the force applying member against the cover element to prevent inadvertent leakage of the pourable component from its original container into the receptacle in the closed state of the cover element.

5. The dispensing system of claim 4 wherein the force means includes at least one spring element that provides a biasing force against the force applying member.

6. The dispensing system of claim 4 wherein the pivot member is disposed between the first and second ends.

7. The dispensing system of claim 3 wherein the dispensing means further includes:

a mechanism for pivotally moving the operating device between the first and second positions.

8. The dispensing system of claim 7 wherein the mechanism for moving the operating device includes:

a cylinder member;

a piston member coupled to the operating device, the piston member being movable within the cylinder member, such that movement of the piston member causes the operating device to move between the first and second positions; and a drive mechanism coupled to the piston member for moving the piston member relative to the cylinder member.

9. The dispensing system of claim 8 wherein the piston member is coupled to the second end of the operating device.

10. The dispensing system of claim 9 wherein the second end of the operating device includes a rotatably mounted roller, and wherein the piston member engages the roller such that movement of the piston device causes rotation of the roller and movement of the operating device between the first and second positions.

11. The dispensing system of claim 8 wherein the drive mechanism is fluid pressure.

12. The dispensing system of claim 11 wherein the fluid pressure is hydraulic fluid pressure.

13. The dispensing system of claim 8 wherein the piston member has a primary position that corresponds to the first position of the operating device, and wherein the mechanism for moving the operating device further includes:

a mechanism for biasing the piston member to the primary position.

14. The dispensing system of claim 13 wherein the biasing mechanism includes at least one spring connected between the support frame and the operating device.

15. The dispensing system of claim 8 wherein the drive mechanism includes:

a cylinder member;

means connecting the cylinder member of the drive mechanism to the cylinder member of the mechanism for moving the operating device;

a piston member movable relative to the cylinder member of the drive mechanism, such that movement of the piston member of the drive mechanism causes movement of the piston member of the mechanism for moving the operating device; and a drive motor coupled to the piston member of the drive mechanism for moving the piston member of the drive mechanism relative to the cylinder member of the drive mechanism.

16. The dispensing system of claim 15 wherein the connecting means of the drive mechanism includes:

a fluid reservoir in fluid communication with the cylinder member of the drive mechanism and the cylinder member of the mechanism for moving the operating device; and a fluid within the fluid reservoir.

17. The dispensing system of claim 16 wherein the connecting means further includes:

a fluid line coupled between the drive mechanism cylinder member and fluid reservoir, and the cylinder member of the mechanism for moving the operating device.

18. The dispensing system of claim 17 wherein the connecting means further includes:

an automatic bleeder valve coupled to the fluid line and the cylinder member of the mechanism for moving the operating device, the automatic bleeder valve including:

a body member defining an orifice extending through the body member from a first end to a second end;

a valve element at the first end of the body member, the valve member being movable between a first position, wherein fluid is prevented from passing through the orifice, and a second position wherein fluid may pass through the orifice from the first end to the second end; and bleeder means coupled to the body member for moving the valve element between the first and second positions.

19. The dispensing system of claim 18 wherein upon charging the drive mechanism with the fluid and with the valve element in the second position, the fluid travels from the fluid line to the cylinder member of the mechanism for moving the operating device such that air is bled from the drive mechanism through the orifice of the body member of the automatic bleeder valve.

20. The dispensing system of claim 18 wherein the bleeder means includes:

a movable bleeder screw having a free end; and a spring member positioned between the free end of the bleeder screw and the valve element.

21. The dispensing system of claim 16 wherein the fluid is hydraulic fluid.

22. The dispensing system of claim 15 wherein the control module is coupled to drive motor for controlling operation of the drive motor and thereby movement of the piston member of the drive mechanism based upon information obtained from the weigh cell.

23. The dispensing system of claim 1 wherein the receiving means for releasably receiving the original container of the pourable component includes:

first means for engaging a first portion of the original container; and second means for engaging a second portion of the original container, the second portion being spaced from the first portion.

24. The dispensing system of claim 23 wherein the original container of the pourable component includes a lid member, and wherein the first and second portions of the original container are first and second portions of the lid member.

25. The dispensing system of claim 23 wherein the second engaging means is movable relative to the support frame between a latched state, wherein the original container of the pourable component is held between the first and second engaging means, and an unlatched state, wherein the original container can be engaged with and disengaged from the first and second engaging means.

26. The dispensing system of claim 25 wherein an operator of the dispensing system moves the second engaging means between the latched and unlatched states.

27. The dispensing system of claim 25 wherein the means for releasably receiving the original container of the pourable component further includes:

means for biasing the second engaging means to the latched state.

28. The dispensing system of claim 27 wherein the biasing means includes a spring connected between the support frame and the second engaging means.

29. The dispensing system of claim 25 wherein the first engaging means is fixed, and wherein the second engaging means has only a single-degree-of-freedom of movement.

30. The dispensing system of claim 29 wherein the first and second engaging means can receive a first size of the original container of the pourable component or a second size of the original container of the pourable component that is different than the first size.

31. The dispensing system of claim 30 wherein the first size is a quart and the second size is a gallon.

32. The dispensing system of claim 1, and further including an apparatus for controlling the dispensing apparatus, the control apparatus including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

33. The dispensing system of claim 32 wherein the control module includes:

a microprocessor device coupled to the weigh cell and the dispensing means;

data storage device coupled to the microprocessor device;

display monitor device coupled to the microprocessor device; and a user interface device for allowing a user to communicate with the microprocessor.

34. The dispensing system of claim 33 wherein the user interface is a keyboard.

35. A system for dispensing pourable components from their original containers into a receptacle according to a formula to form a mixture of pourable components, the dispensing system comprising:

a dispensing apparatus for dispensing a pourable component from its original container, the dispensing apparatus including:

a support frame;

dispensing means, coupled to the support frame, for dispensing the pourable component from its original container into a receptacle;

first engaging means mounted to the support frame so as to be fixed against movement, the first engaging means releasably engaging a first portion of the original container of the pourable component; and second engaging means mounted to the support frame so as to exhibit only a single-degree-of-freedom of movement, the second engaging means releasably engaging a second portion of the original container, such that the first and second engaging means can receive a first size of the original container of the pourable component or a second size of the original container of the pourable component.

36. The dispensing system of claim 35 wherein the first size is a quart and the second size is a gallon.

37. The dispensing system of claim 35 wherein the original container of the pourable component includes a lid member, and wherein the first and second portions of the original container are first and second portions of the lid member.

38. The dispensing system of claim 35 wherein the second engaging means is movable between a latched state, wherein a desired size of the first and second sizes of the original container of the pourable component is held between the first and second engaging means, and an unlatched state, wherein the desired size of the first and second sizes of the original container can be engaged with and disengaged from the first and second engaging means.

39. The dispensing system of claim 38 wherein an operator of the dispensing system moves the second engaging means between the latched and unlatched states.

40. The dispensing system of claim 38 wherein the dispensing apparatus further includes:

means for biasing the second engaging means to the latched state.

41. The dispensing system of claim 40 wherein the biasing means includes a spring connected between the support frame and the second engaging means.

42. The dispensing system of claim 35, and further including:

an apparatus for controlling the dispensing apparatus, including:

a weigh cell for supporting the receptacle and for determining the weight of the pourable component dispensed into the receptacle; and a control module coupled to the weigh cell and the dispensing means for controlling the amount of the pourable component dispensed from its original container, based upon information obtained from the weigh cell.

43. The dispensing system of claim 35 wherein the pourable component is a liquid paint component, the receptacle is a paint receptacle, the formula is a paint formula, and the mixture of pourable components is a liquid paint mixture.

44. A system for dispensing pourable components from their original containers into a receptacle according to a formula to form a mixture of pourable components, the dispensing system comprising:

a dispensing apparatus for dispensing a pourable component from its original container, the dispensing apparatus including:

a support frame;

receiving means, coupled to the support frame, for releasably receiving the original container;

an operating device, coupled to the support frame, for releasably engaging a movable cover element of the original container of the pourable component, the operating device being movable between a first position, wherein the cover element is in a closed state, and a second position, wherein the cover element is in an opened state and the pourable component is dispensed from the original container and into a receptacle, the operating device including:

a cylinder member;

a piston member coupled to the operating device, the piston member being movable within the cylinder member, such that movement of the piston member causes the operating device to move between the first and second positions;

a fluid drive mechanism coupled to the piston member for moving the piston member relative to the cylinder member; and an automatic bleeder valve coupled to the fluid drive mechanism and the cylinder member, the automatic bleeder valve including:

a body member defining an orifice extending through the body member from a first end to a second end;

a valve element at the first end of the body member, the valve member being movable between a first position, wherein fluid is prevented from passing through the orifice, and a second position wherein fluid may pass through the orifice from the first end to the second end; and bleeder means coupled to the body member for moving the valve element between the first and second positions.

45. The dispensing system of claim 44 wherein upon charging the drive mechanism with fluid and with the valve element in the second position, fluid travels from the fluid drive mechanism to the cylinder member of the operating device such that air is bled from the fluid drive mechanism and cylinder member through the orifice of the body member of the automatic bleeder valve.

46. The dispensing system of claim 44 wherein the bleeder means includes:

a movable bleeder screw having a free end; and a spring member positioned between the free end of the bleeder screw and the valve element.

47. The dispensing system of claim 44 wherein the fluid drive mechanism includes:

a cylinder member;

means connecting the cylinder member of the fluid drive mechanism to the cylinder member of the operating device and the automatic bleeder valve;

a piston member movable relative to the cylinder member of the fluid drive mechanism, such that movement of the piston member of the fluid drive mechanism causes movement of the piston member of the operating device; and a drive motor coupled to the piston member of the drive mechanism for moving the piston member of the drive mechanism relative to the cylinder member of the drive mechanism.

48. The dispensing system of claim 47 wherein the connecting means of the drive mechanism includes:

a fluid reservoir in fluid communication with the cylinder member of the fluid drive mechanism, the cylinder member of the operating device, and the automatic bleeder valve; and a fluid within the fluid reservoir.

49. The dispensing system of claim 47 and further including:

an apparatus for controlling the dispensing apparatus, including:

a weigh cell for supporting the receptacle and for determining the weight of the pourable component dispensed into the receptacle from the original container; and a control module coupled to the weigh cell and the drive motor for controlling operation of the drive motor based upon information obtained from the weigh cell, and thereby the amount of the pourable component dispensed from its original container into the receptacle.

50. The dispensing system of claim 44 wherein the pourable component is a liquid paint component, the receptacle is a paint receptacle, the formula is a paint formula, and the mixture of pourable components is a liquid paint mixture.

* * * * *

UNITED STATES PATENT AND TRADEMARK OFFICE

CERTIFICATE OF CORRECTION

PATENT NO. : 6,234,218 B1
DATED : May 22, 2001
INVENTOR(S) : Arie Boers

It is certified that error appears in the above-identified patent and that said Letters Patent is hereby corrected as shown below:

Column 1,
Lines 18-19, please delete "Ser. No. 09/416,687" and insert -- Ser. No. 09/416,871 --.

Column 10,
Line 3, please delete "biasing force urges" and insert -- "biasing force and urges" --.
Line 36, please delete "FIGS. 6-- and insert -- FIG. 6 --.

Column 12,
Line 49, please delete "device 196 the data" and insert -- device 196 of the data --.

Signed and Sealed this

Twenty-seventh Day of November, 2001

*Attest:*

Nicholas P. Godici

NICHOLAS P. GODICI

*Attesting Officer*

*Acting Director of the United States Patent and Trademark Office*